US008858251B2

(12) United States Patent
Montena

(10) Patent No.: US 8,858,251 B2
(45) **Date of Patent: *Oct. 14, 2014**

(54) CONNECTOR HAVING A COUPLER-BODY CONTINUITY MEMBER

(71) Applicant: PPC Broadband, Inc., East Syracuse, NY (US)

(72) Inventor: Noah P. Montena, Syracuse, NY (US)

(73) Assignee: PPC Broadband, Inc., East Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/091,875

(22) Filed: Nov. 27, 2013

(65) Prior Publication Data

US 2014/0087574 A1 Mar. 27, 2014

Related U.S. Application Data

(63) Continuation of application No. 13/712,470, filed on Dec. 12, 2012, which is a continuation of application No. 13/016,114, filed on Jan. 28, 2011, now Pat. No. 8,337,229.

(60) Provisional application No. 61/412,611, filed on Nov. 11, 2010.

(51) Int. Cl.

| | |
|---|---|
| ***H01R 13/62*** | (2006.01) |
| ***H01R 9/05*** | (2006.01) |
| ***H01R 43/20*** | (2006.01) |
| ***H01R 24/38*** | (2011.01) |
| ***H01R 13/52*** | (2006.01) |
| ***H01R 13/655*** | (2006.01) |
| ***H01R 43/26*** | (2006.01) |
| ***H01R 13/6581*** | (2011.01) |
| ***H01R 43/00*** | (2006.01) |
| ***H01R 13/646*** | (2011.01) |
| *H01R 13/622* | (2006.01) |

(52) U.S. Cl.

CPC ..... *H01R 13/655* (2013.01); *H01R 9/0512* (2013.01); *H01R 43/20* (2013.01); *H01R 24/38* (2013.01); *H01R 13/5221* (2013.01); *H01R 43/26* (2013.01); *H01R 13/622* (2013.01); *H01R 13/6581* (2013.01); *H01R 43/00* (2013.01); *H01R 9/05* (2013.01); *H01R 13/646* (2013.01); *H01R 13/5202* (2013.01)

USPC ..... 439/322

(58) Field of Classification Search

USPC ..... 439/271, 578, 676–678

See application file for complete search history.

(56) References Cited

U.S. PATENT DOCUMENTS

| | | | |
|---|---|---|---|
| 331,169 | A | 11/1885 | Thomas |
| 1,371,742 | A | 3/1921 | Dringman |

(Continued)

FOREIGN PATENT DOCUMENTS

| | | | |
|---|---|---|---|
| CA | 2096710.00 | A1 | 11/1994 |
| CN | 1383594.00 | A | 12/2002 |

(Continued)

OTHER PUBLICATIONS

Chinese Office Action dated Dec. 12, 2013, for corresponding CN Application No. 201010229211.4. 8 pages. (English Translation).

(Continued)

*Primary Examiner* — R S Luebke
*Assistant Examiner* — Larisa Tsukerman
(74) *Attorney, Agent, or Firm* — Hiscock & Barclay LLP

(57) ABSTRACT

A connector having a coupler-body continuity member is provided, wherein the coupler-body continuity member electrically couples a coupler and a body, thereby establishing electrical continuity between the coupler and the body. Furthermore, the coupler-body continuity member facilitates grounding through the connector, and renders an electromagnetic shield preventing ingress of unwanted environmental noise.

132 Claims, 14 Drawing Sheets

(56) References Cited

U.S. PATENT DOCUMENTS

| | | | |
|---|---|---|---|
| 1,667,485 | A | 4/1928 | MacDonald |
| 1,766,869 | A | 6/1930 | Austin |
| 1,801,999 | A | 4/1931 | Bowman |
| 1,885,761 | A | 11/1932 | Peirce, Jr. |
| 2,013,526 | A | 9/1935 | Schmitt |
| 2,102,495 | A | 12/1937 | England |
| 2,258,737 | A | 10/1941 | Browne |
| 2,325,549 | A | 7/1943 | Ryzowitz |
| 2,480,963 | A | 9/1949 | Quinn |
| 2,544,654 | A | 3/1951 | Brown |
| 2,549,647 | A | 4/1951 | Turenne |
| 2,665,729 | A | 1/1954 | Terry |
| 2,694,187 | A | 11/1954 | Nash |
| 2,694,817 | A | 11/1954 | Roderick |
| 2,754,487 | A | 7/1956 | Carr et al. |
| 2,755,331 | A | 7/1956 | Melcher |
| 2,757,351 | A | 7/1956 | Klostermann |
| 2,762,025 | A | 9/1956 | Melcher |
| 2,805,399 | A | 9/1957 | Leeper |
| 2,816,949 | A | 12/1957 | Curtiss |
| 2,870,420 | A | 1/1959 | Malek |
| 3,001,169 | A | 9/1961 | Blonder |
| 3,015,794 | A | 1/1962 | Kishbaugh |
| 3,091,748 | A | 5/1963 | Takes et al. |
| 3,094,364 | A | 6/1963 | Lingg |
| 3,184,706 | A | 5/1965 | Atkins |
| 3,194,292 | A | 7/1965 | Borowsky |
| 3,196,382 | A | 7/1965 | Morello, Jr. |
| 3,245,027 | A | 4/1966 | Ziegler, Jr. |
| 3,275,913 | A | 9/1966 | Blanchard et al. |
| 3,278,890 | A | 10/1966 | Cooney |
| 3,281,757 | A | 10/1966 | Bonhomme |
| 3,292,136 | A | 12/1966 | Somerset |
| 3,320,575 | A | 5/1967 | Brown et al. |
| 3,321,732 | A | 5/1967 | Forney, Jr. |
| 3,336,563 | A | 8/1967 | Hyslop |
| 3,348,186 | A | 10/1967 | Rosen |
| 3,350,677 | A | 10/1967 | Daum |
| 3,355,698 | A | 11/1967 | Keller |
| 3,373,243 | A | 3/1968 | Janowiak et al. |
| 3,390,374 | A | 6/1968 | Forney, Jr. |
| 3,406,373 | A | 10/1968 | Forney, Jr. |
| 3,430,184 | A | 2/1969 | Acord |
| 3,448,430 | A | 6/1969 | Kelly |
| 3,453,376 | A | 7/1969 | Ziegler, Jr. et al. |
| 3,465,281 | A | 9/1969 | Florer |
| 3,475,545 | A | 10/1969 | Stark et al. |
| 3,494,400 | A | 2/1970 | McCoy et al. |
| 3,498,647 | A | 3/1970 | Schroder |
| 3,501,737 | A | 3/1970 | Harris et al. |
| 3,517,373 | A | 6/1970 | Jamon |
| 3,526,871 | A | 9/1970 | Hobart |
| 3,533,051 | A | 10/1970 | Ziegler, Jr. |
| 3,537,065 | A | 10/1970 | Winston |
| 3,544,705 | A | 12/1970 | Winston |
| 3,551,882 | A | 12/1970 | O'Keefe |
| 3,564,487 | A | 2/1971 | Upstone et al. |
| 3,587,033 | A | 6/1971 | Brorein et al. |
| 3,601,776 | A | 8/1971 | Curl |
| 3,629,792 | A | 12/1971 | Dorrell |
| 3,633,150 | A | 1/1972 | Swartz |
| 3,646,502 | A | 2/1972 | Hutter et al. |
| 3,663,926 | A | 5/1972 | Brandt |
| 3,665,371 | A | 5/1972 | Cripps |
| 3,668,612 | A | 6/1972 | Nepovim |
| 3,669,472 | A | 6/1972 | Nadsady |
| 3,671,922 | A | 6/1972 | Zerlin et al. |
| 3,678,444 | A | 7/1972 | Stevens et al. |
| 3,678,445 | A | 7/1972 | Brancaleone |
| 3,680,034 | A | 7/1972 | Chow et al. |
| 3,681,739 | A | 8/1972 | Kornick |
| 3,683,320 | A | 8/1972 | Woods et al. |
| 3,686,623 | A | 8/1972 | Nijman |
| 3,694,792 | A | 9/1972 | Wallo |
| 3,706,958 | A | 12/1972 | Blanchenot |
| 3,710,005 | A | 1/1973 | French |
| 3,739,076 | A | 6/1973 | Schwartz |
| 3,744,007 | A | 7/1973 | Horak |
| 3,744,011 | A | 7/1973 | Blanchenot |
| 3,778,535 | A | 12/1973 | Forney, Jr. |
| 3,781,762 | A | 12/1973 | Quackenbush |
| 3,781,898 | A | 12/1973 | Holloway |
| 3,793,610 | A | 2/1974 | Brishka |
| 3,798,589 | A | 3/1974 | Deardurff |
| 3,808,580 | A | 4/1974 | Johnson |
| 3,810,076 | A | 5/1974 | Hutter |
| 3,835,443 | A | 9/1974 | Arnold et al. |
| 3,836,700 | A | 9/1974 | Niemeyer |
| 3,845,453 | A | 10/1974 | Hemmer |
| 3,846,738 | A | 11/1974 | Nepovim |
| 3,854,003 | A | 12/1974 | Duret |
| 3,858,156 | A | 12/1974 | Zarro |
| 3,870,978 | A | 3/1975 | Dreyer |
| 3,879,102 | A | 4/1975 | Horak |
| 3,886,301 | A | 5/1975 | Cronin et al. |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,953,097 | A | 4/1976 | Graham |
| 3,960,428 | A | 6/1976 | Naus et al. |
| 3,963,320 | A | 6/1976 | Spinner |
| 3,963,321 | A | 6/1976 | Burger et al. |
| 3,970,355 | A | 7/1976 | Pitschi |
| 3,972,013 | A | 7/1976 | Shapiro |
| 3,976,352 | A | 8/1976 | Spinner |
| 3,980,805 | A | 9/1976 | Lipari |
| 3,985,418 | A | 10/1976 | Spinner |
| 4,017,139 | A | 4/1977 | Nelson |
| 4,022,966 | A | 5/1977 | Gajajiva |
| 4,030,798 | A | 6/1977 | Paoli |
| 4,046,451 | A | 9/1977 | Juds et al. |
| 4,053,200 | A | 10/1977 | Pugner |
| 4,059,330 | A | 11/1977 | Shirey |
| 4,079,343 | A | 3/1978 | Nijman |
| 4,082,404 | A | 4/1978 | Flatt |
| 4,090,028 | A | 5/1978 | Vontobel |
| 4,093,335 | A | 6/1978 | Schwartz et al. |
| 4,106,839 | A | 8/1978 | Cooper |
| 4,109,126 | A | 8/1978 | Halbeck |
| 4,125,308 | A | 11/1978 | Schilling |
| 4,126,372 | A | 11/1978 | Hashimoto et al. |
| 4,131,332 | A | 12/1978 | Hogendobler et al. |
| 4,150,250 | A | 4/1979 | Lundeberg |
| 4,153,320 | A | 5/1979 | Townshend |
| 4,156,554 | A | 5/1979 | Aujla |
| 4,165,911 | A | 8/1979 | Laudig |
| 4,168,921 | A | 9/1979 | Blanchard |
| 4,173,385 | A | 11/1979 | Fenn et al. |
| 4,174,875 | A | 11/1979 | Wilson et al. |
| 4,187,481 | A | 2/1980 | Boutros |
| 4,193,655 | A | 3/1980 | Herrmann, Jr. |
| 4,194,338 | A | 3/1980 | Trafton |
| 4,213,664 | A | 7/1980 | McClenan |
| 4,225,162 | A | 9/1980 | Dola |
| 4,227,765 | A | 10/1980 | Neumann et al. |
| 4,229,714 | A | 10/1980 | Yu |
| 4,250,348 | A | 2/1981 | Kitagawa |
| 4,280,749 | A | 7/1981 | Hemmer |
| 4,285,564 | A | 8/1981 | Spinner |
| 4,290,663 | A | 9/1981 | Fowler et al. |
| 4,296,986 | A | 10/1981 | Herrmann et al. |
| 4,307,926 | A | 12/1981 | Smith |
| 4,322,121 | A | 3/1982 | Riches et al. |
| 4,326,769 | A | 4/1982 | Dorsey et al. |
| 4,339,166 | A | 7/1982 | Dayton |
| 4,346,958 | A | 8/1982 | Blanchard |
| 4,354,721 | A | 10/1982 | Luzzi |
| 4,358,174 | A | 11/1982 | Dreyer |
| 4,359,254 | A | 11/1982 | Gallusser |
| 4,373,767 | A | 2/1983 | Cairns |
| 4,389,081 | A | 6/1983 | Gallusser et al. |
| 4,400,050 | A | 8/1983 | Hayward |
| 4,407,529 | A | 10/1983 | Holman |

(56) References Cited

U.S. PATENT DOCUMENTS

| | | | |
|---|---|---|---|
| 4,408,821 | A | 10/1983 | Forney, Jr. |
| 4,408,822 | A | 10/1983 | Nikitas |
| 4,412,717 | A | 11/1983 | Monroe |
| 4,421,377 | A | 12/1983 | Spinner |
| 4,426,127 | A | 1/1984 | Kubota |
| 4,444,453 | A | 4/1984 | Kirby et al. |
| 4,452,503 | A | 6/1984 | Forney, Jr. |
| 4,456,323 | A | 6/1984 | Pitcher et al. |
| 4,462,653 | A | 7/1984 | Flederbach et al. |
| 4,464,000 | A | 8/1984 | Werth et al. |
| 4,464,001 | A | 8/1984 | Collins |
| 4,469,386 | A | 9/1984 | Ackerman |
| 4,470,657 | A | 9/1984 | Deacon |
| 4,484,792 | A | 11/1984 | Tengler et al. |
| 4,484,796 | A | 11/1984 | Sato et al. |
| 4,490,576 | A | 12/1984 | Bolante et al. |
| 4,506,943 | A | 3/1985 | Drogo |
| 4,515,427 | A | 5/1985 | Smit |
| 4,525,017 | A | 6/1985 | Schildkraut et al. |
| 4,531,790 | A | 7/1985 | Selvin |
| 4,531,805 | A | 7/1985 | Werth |
| 4,533,191 | A | 8/1985 | Blackwood |
| 4,540,231 | A | 9/1985 | Forney, Jr. |
| RE31,995 | E | 10/1985 | Ball |
| 4,545,637 | A | 10/1985 | Bosshard et al. |
| 4,575,274 | A | 3/1986 | Hayward |
| 4,580,862 | A | 4/1986 | Johnson |
| 4,580,865 | A | 4/1986 | Fryberger |
| 4,583,811 | A | 4/1986 | McMills |
| 4,585,289 | A | 4/1986 | Bocher |
| 4,588,246 | A | 5/1986 | Schildkraut et al. |
| 4,593,964 | A | 6/1986 | Forney, Jr. et al. |
| 4,596,434 | A | 6/1986 | Saba et al. |
| 4,596,435 | A | 6/1986 | Bickford |
| 4,597,621 | A | 7/1986 | Burns |
| 4,598,959 | A | 7/1986 | Selvin |
| 4,598,961 | A | 7/1986 | Cohen |
| 4,600,263 | A | 7/1986 | DeChamp et al. |
| 4,613,199 | A | 9/1986 | McGeary |
| 4,614,390 | A | 9/1986 | Baker |
| 4,616,900 | A | 10/1986 | Cairns |
| 4,632,487 | A | 12/1986 | Wargula |
| 4,634,213 | A | 1/1987 | Larsson et al. |
| 4,640,572 | A | 2/1987 | Conlon |
| 4,645,281 | A | 2/1987 | Burger |
| 4,650,228 | A | 3/1987 | McMills et al. |
| 4,655,159 | A | 4/1987 | McMills |
| 4,655,534 | A | 4/1987 | Stursa |
| 4,660,921 | A | 4/1987 | Hauver |
| 4,668,043 | A | 5/1987 | Saba et al. |
| 4,673,236 | A | 6/1987 | Musolff et al. |
| 4,674,818 | A | 6/1987 | McMills et al. |
| 4,676,577 | A | 6/1987 | Szegda |
| 4,682,832 | A | 7/1987 | Punako et al. |
| 4,684,201 | A | 8/1987 | Hutter |
| 4,688,876 | A | 8/1987 | Morelli |
| 4,688,878 | A | 8/1987 | Cohen et al. |
| 4,690,482 | A | 9/1987 | Chamberland et al. |
| 4,691,976 | A | 9/1987 | Cowen |
| 4,703,987 | A | 11/1987 | Gallusser et al. |
| 4,703,988 | A | 11/1987 | Raux et al. |
| 4,717,355 | A | 1/1988 | Mattis |
| 4,720,155 | A | 1/1988 | Schildkraut et al. |
| 4,734,050 | A | 3/1988 | Negre et al. |
| 4,734,666 | A | 3/1988 | Ohya et al. |
| 4,737,123 | A | 4/1988 | Paler et al. |
| 4,738,009 | A | 4/1988 | Down et al. |
| 4,738,628 | A | 4/1988 | Rees |
| 4,739,126 | A | 4/1988 | Gutter et al. |
| 4,746,305 | A | 5/1988 | Nomura |
| 4,747,786 | A | 5/1988 | Hayashi et al. |
| 4,749,821 | A | 6/1988 | Linton et al. |
| 4,755,152 | A | 7/1988 | Elliot et al. |
| 4,757,297 | A | 7/1988 | Frawley |
| 4,759,729 | A | 7/1988 | Kemppainen et al. |
| 4,761,146 | A | 8/1988 | Sohoel |
| 4,772,222 | A | 9/1988 | Laudig et al. |
| 4,789,355 | A | 12/1988 | Lee |
| 4,789,759 | A | 12/1988 | Jones |
| 4,795,360 | A | 1/1989 | Newman et al. |
| 4,797,120 | A | 1/1989 | Ulery |
| 4,806,116 | A | 2/1989 | Ackerman |
| 4,807,891 | A | 2/1989 | Neher |
| 4,808,128 | A | 2/1989 | Werth |
| 4,813,886 | A | 3/1989 | Roos et al. |
| 4,820,185 | A | 4/1989 | Moulin |
| 4,834,675 | A | 5/1989 | Samchisen |
| 4,835,342 | A | 5/1989 | Guginsky |
| 4,836,801 | A | 6/1989 | Ramirez |
| 4,838,813 | A | 6/1989 | Pauza et al. |
| 4,854,893 | A | 8/1989 | Morris |
| 4,857,014 | A | 8/1989 | Alf et al. |
| 4,867,706 | A | 9/1989 | Tang |
| 4,869,679 | A | 9/1989 | Szegda |
| 4,874,331 | A | 10/1989 | Iverson |
| 4,892,275 | A | 1/1990 | Szegda |
| 4,902,246 | A | 2/1990 | Samchisen |
| 4,906,207 | A | 3/1990 | Banning et al. |
| 4,915,651 | A | 4/1990 | Bout |
| 4,921,447 | A | 5/1990 | Capp et al. |
| 4,923,412 | A | 5/1990 | Morris |
| 4,925,403 | A | 5/1990 | Zorzy |
| 4,927,385 | A | 5/1990 | Cheng |
| 4,929,188 | A | 5/1990 | Lionetto et al. |
| 4,934,960 | A | 6/1990 | Capp et al. |
| 4,938,718 | A | 7/1990 | Guendel |
| 4,941,846 | A | 7/1990 | Guimond et al. |
| 4,952,174 | A | 8/1990 | Sucht et al. |
| 4,957,456 | A | 9/1990 | Olson et al. |
| 4,973,265 | A | 11/1990 | Heeren |
| 4,979,911 | A | 12/1990 | Spencer |
| 4,990,104 | A | 2/1991 | Schieferly |
| 4,990,105 | A | 2/1991 | Karlovich |
| 4,990,106 | A | 2/1991 | Szegda |
| 4,992,061 | A | 2/1991 | Brush, Jr. et al. |
| 5,002,503 | A | 3/1991 | Campbell et al. |
| 5,007,861 | A | 4/1991 | Stirling |
| 5,011,422 | A | 4/1991 | Yeh |
| 5,011,432 | A | 4/1991 | Sucht et al. |
| 5,021,010 | A | 6/1991 | Wright |
| 5,024,606 | A | 6/1991 | Ming-Hwa |
| 5,030,126 | A | 7/1991 | Hanlon |
| 5,037,328 | A | 8/1991 | Karlovich |
| 5,046,964 | A | 9/1991 | Welsh et al. |
| 5,052,947 | A | 10/1991 | Brodie et al. |
| 5,055,060 | A | 10/1991 | Down et al. |
| 5,059,747 | A | 10/1991 | Bawa et al. |
| 5,062,804 | A | 11/1991 | Jamet et al. |
| 5,066,248 | A | 11/1991 | Gaver, Jr. et al. |
| 5,073,129 | A | 12/1991 | Szegda |
| 5,080,600 | A | 1/1992 | Baker et al. |
| 5,083,943 | A | 1/1992 | Tarrant |
| 5,120,260 | A | 6/1992 | Jackson |
| 5,127,853 | A | 7/1992 | McMills et al. |
| 5,131,862 | A | 7/1992 | Gershfeld |
| 5,137,470 | A | 8/1992 | Doles |
| 5,137,471 | A | 8/1992 | Verespej et al. |
| 5,141,448 | A | 8/1992 | Mattingly et al. |
| 5,141,451 | A | 8/1992 | Down |
| 5,149,274 | A | 9/1992 | Gallusser et al. |
| 5,154,636 | A | 10/1992 | Vaccaro et al. |
| 5,161,993 | A | 11/1992 | Leibfried, Jr. |
| 5,166,477 | A | 11/1992 | Perin, Jr. et al. |
| 5,169,323 | A | 12/1992 | Kawai et al. |
| 5,181,161 | A | 1/1993 | Hirose et al. |
| 5,183,417 | A | 2/1993 | Bools |
| 5,186,501 | A | 2/1993 | Mano |
| 5,186,655 | A | 2/1993 | Glenday et al. |
| 5,195,905 | A | 3/1993 | Pesci |
| 5,195,906 | A | 3/1993 | Szegda |
| 5,205,547 | A | 4/1993 | Mattingly |
| 5,205,761 | A | 4/1993 | Nilsson |
| 5,207,602 | A | 5/1993 | McMills et al. |
| 5,215,477 | A | 6/1993 | Weber et al. |

(56) References Cited

U.S. PATENT DOCUMENTS

| | | | |
|---|---|---|---|
| 5,217,391 | A | 6/1993 | Fisher, Jr. |
| 5,217,393 | A | 6/1993 | Del Negro et al. |
| 5,221,216 | A | 6/1993 | Gabany et al. |
| 5,227,587 | A | 7/1993 | Paterek |
| 5,247,424 | A | 9/1993 | Harris et al. |
| 5,269,701 | A | 12/1993 | Leibfried, Jr. |
| 5,283,853 | A | 2/1994 | Szegda |
| 5,284,449 | A | 2/1994 | Vaccaro |
| 5,294,864 | A | 3/1994 | Do |
| 5,295,864 | A | 3/1994 | Birch et al. |
| 5,316,494 | A | 5/1994 | Flanagan et al. |
| 5,318,459 | A | 6/1994 | Shields |
| 5,321,205 | A | 6/1994 | Bawa et al. |
| 5,334,032 | A | 8/1994 | Myers et al. |
| 5,334,051 | A | 8/1994 | Devine et al. |
| 5,338,225 | A | 8/1994 | Jacobsen et al. |
| 5,342,218 | A | 8/1994 | McMills et al. |
| 5,354,217 | A | 10/1994 | Gabel et al. |
| 5,362,250 | A | 11/1994 | McMills et al. |
| 5,371,819 | A | 12/1994 | Szegda |
| 5,371,821 | A | 12/1994 | Szegda |
| 5,371,827 | A | 12/1994 | Szegda |
| 5,380,211 | A | 1/1995 | Kawagauchi et al. |
| 5,389,005 | A | 2/1995 | Kodama |
| 5,393,244 | A | 2/1995 | Szegda |
| 5,397,252 | A | 3/1995 | Wang |
| 5,413,504 | A | 5/1995 | Kloecker et al. |
| 5,431,583 | A | 7/1995 | Szegda |
| 5,435,745 | A | 7/1995 | Booth |
| 5,435,751 | A | 7/1995 | Papenheim et al. |
| 5,439,386 | A | 8/1995 | Ellis et al. |
| 5,444,810 | A | 8/1995 | Szegda |
| 5,455,548 | A | 10/1995 | Grandchamp et al. |
| 5,456,611 | A | 10/1995 | Henry et al. |
| 5,456,614 | A | 10/1995 | Szegda |
| 5,466,173 | A | 11/1995 | Down |
| 5,470,257 | A | 11/1995 | Szegda |
| 5,474,478 | A | 12/1995 | Ballog |
| 5,490,033 | A | 2/1996 | Cronin |
| 5,490,801 | A | 2/1996 | Fisher, Jr. et al. |
| 5,494,454 | A | 2/1996 | Johnsen |
| 5,499,934 | A | 3/1996 | Jacobsen et al. |
| 5,501,616 | A | 3/1996 | Holliday |
| 5,509,823 | A | 4/1996 | Harting et al. |
| 5,516,303 | A | 5/1996 | Yohn et al. |
| 5,525,076 | A | 6/1996 | Down |
| 5,542,861 | A | 8/1996 | Anhalt et al. |
| 5,548,088 | A | 8/1996 | Gray et al. |
| 5,550,521 | A | 8/1996 | Bernaud et al. |
| 5,564,938 | A | 10/1996 | Shenkal et al. |
| 5,571,028 | A | 11/1996 | Szegda |
| 5,586,910 | A | 12/1996 | Del Negro et al. |
| 5,595,499 | A | 1/1997 | Zander et al. |
| 5,598,132 | A | 1/1997 | Stabile |
| 5,607,325 | A | 3/1997 | Toma |
| 5,620,339 | A | 4/1997 | Gray et al. |
| 5,632,637 | A | 5/1997 | Diener |
| 5,632,651 | A | 5/1997 | Szegda |
| 5,644,104 | A | 7/1997 | Porter et al. |
| 5,651,698 | A | 7/1997 | Locati et al. |
| 5,651,699 | A | 7/1997 | Holliday |
| 5,653,605 | A | 8/1997 | Woehl et al. |
| 5,667,405 | A | 9/1997 | Holliday |
| 5,681,172 | A | 10/1997 | Moldenhauer |
| 5,683,263 | A | 11/1997 | Hse |
| 5,702,263 | A | 12/1997 | Baumann et al. |
| 5,722,856 | A | 3/1998 | Fuchs et al. |
| 5,735,704 | A | 4/1998 | Anthony |
| 5,746,617 | A | 5/1998 | Porter, Jr. et al. |
| 5,746,619 | A | 5/1998 | Harting et al. |
| 5,769,652 | A | 6/1998 | Wider |
| 5,775,927 | A | 7/1998 | Wider |
| 5,863,220 | A | 1/1999 | Holliday |
| 5,877,452 | A | 3/1999 | McConnell |
| 5,879,191 | A | 3/1999 | Burris |
| 5,882,226 | A | 3/1999 | Bell et al. |
| 5,897,795 | A | 4/1999 | Lu et al. |
| 5,921,793 | A | 7/1999 | Phillips |
| 5,938,465 | A | 8/1999 | Fox, Sr. |
| 5,944,548 | A | 8/1999 | Saito |
| 5,951,327 | A | 9/1999 | Marik |
| 5,957,716 | A | 9/1999 | Buckley et al. |
| 5,967,852 | A | 10/1999 | Follingstad et al. |
| 5,975,949 | A | 11/1999 | Holliday et al. |
| 5,975,951 | A | 11/1999 | Burris et al. |
| 5,977,841 | A | 11/1999 | Lee et al. |
| 5,997,350 | A | 12/1999 | Burris et al. |
| 6,010,349 | A | 1/2000 | Porter, Jr. |
| 6,019,635 | A | 2/2000 | Nelson |
| 6,022,237 | A | 2/2000 | Esh |
| 6,032,358 | A | 3/2000 | Wild |
| 6,042,422 | A | 3/2000 | Youtsey |
| 6,048,229 | A | 4/2000 | Lazaro, Jr. |
| 6,053,743 | A | 4/2000 | Mitchell et al. |
| 6,053,769 | A | 4/2000 | Kubota et al. |
| 6,053,777 | A | 4/2000 | Boyle |
| 6,083,053 | A | 7/2000 | Anderson, Jr. et al. |
| 6,089,903 | A | 7/2000 | Stafford Gray et al. |
| 6,089,912 | A | 7/2000 | Tallis et al. |
| 6,089,913 | A | 7/2000 | Holliday |
| 6,123,567 | A | 9/2000 | McCarthy |
| 6,146,197 | A | 11/2000 | Holliday et al. |
| 6,152,753 | A | 11/2000 | Johnson et al. |
| 6,153,830 | A | 11/2000 | Montena |
| 6,162,995 | A | 12/2000 | Bachle et al. |
| 6,210,216 | B1 | 4/2001 | Tso-Chin et al. |
| 6,210,222 | B1 | 4/2001 | Langham et al. |
| 6,217,383 | B1 | 4/2001 | Holland et al. |
| 6,239,359 | B1 | 5/2001 | Lilienthal, II et al. |
| 6,241,553 | B1 | 6/2001 | Hsia |
| 6,257,923 | B1 | 7/2001 | Stone et al. |
| 6,261,126 | B1 | 7/2001 | Stirling |
| 6,267,612 | B1 | 7/2001 | Arcykiewicz et al. |
| 6,271,464 | B1 | 8/2001 | Cunningham |
| 6,331,123 | B1 | 12/2001 | Rodrigues |
| 6,332,815 | B1 | 12/2001 | Bruce |
| 6,358,077 | B1 | 3/2002 | Young |
| 6,383,019 | B1 | 5/2002 | Wild |
| D458,904 | S | 6/2002 | Montena |
| 6,406,330 | B2 | 6/2002 | Bruce |
| D460,739 | S | 7/2002 | Fox |
| D460,740 | S | 7/2002 | Montena |
| D460,946 | S | 7/2002 | Montena |
| D460,947 | S | 7/2002 | Montena |
| D460,948 | S | 7/2002 | Montena |
| 6,422,900 | B1 | 7/2002 | Hogan |
| 6,425,782 | B1 | 7/2002 | Holland |
| D461,166 | S | 8/2002 | Montena |
| D461,167 | S | 8/2002 | Montena |
| D461,778 | S | 8/2002 | Fox |
| D462,058 | S | 8/2002 | Montena |
| D462,060 | S | 8/2002 | Fox |
| 6,439,899 | B1 | 8/2002 | Muzslay et al. |
| D462,327 | S | 9/2002 | Montena |
| 6,468,100 | B1 | 10/2002 | Meyer et al. |
| 6,491,546 | B1 | 12/2002 | Perry |
| D468,696 | S | 1/2003 | Montena |
| 6,506,083 | B1 | 1/2003 | Bickford et al. |
| 6,520,800 | B1 | 2/2003 | Michelbach et al. |
| 6,530,807 | B2 | 3/2003 | Rodrigues et al. |
| 6,540,531 | B2 | 4/2003 | Syed et al. |
| 6,558,194 | B2 | 5/2003 | Montena |
| 6,572,419 | B2 | 6/2003 | Feye-Homann |
| 6,576,833 | B2 | 6/2003 | Covaro et al. |
| 6,619,876 | B2 | 9/2003 | Vaitkus et al. |
| 6,634,906 | B1 | 10/2003 | Yeh |
| 6,676,446 | B2 | 1/2004 | Montena |
| 6,683,253 | B1 | 1/2004 | Lee |
| 6,692,285 | B2 | 2/2004 | Isalm |
| 6,692,286 | B1 | 2/2004 | De Cet |
| 6,705,884 | B1 | 3/2004 | McCarthy |
| 6,709,280 | B1 | 3/2004 | Gretz |
| 6,712,631 | B1 | 3/2004 | Youtsey |
| 6,716,041 | B2 | 4/2004 | Ferderer et al. |

(56) References Cited

U.S. PATENT DOCUMENTS 6,716,062 B1 4/2004 Palinkas et al.
6,733,336 B1 5/2004 Montena et al.
6,733,337 B2 5/2004 Kodaira
6,752,633 B2 6/2004 Aizawa et al.
6,767,248 B1 7/2004 Hung
6,769,926 B1 8/2004 Montena
6,769,933 B2 8/2004 Bence et al.
6,780,029 B1 8/2004 Gretz
6,780,052 B2 8/2004 Montena et al.
6,780,068 B2 8/2004 Bartholoma et al.
6,786,767 B1 9/2004 Fuks et al.
6,790,081 B2 9/2004 Burris et al.
6,805,584 B1 10/2004 Chen
6,817,896 B2 11/2004 Derenthal
6,817,897 B2 11/2004 Chee
6,848,939 B2 2/2005 Stirling
6,848,940 B2 2/2005 Montena
6,873,864 B2 3/2005 Kai et al.
6,882,247 B2 4/2005 Allison et al.
6,884,113 B1 4/2005 Montena
6,884,115 B2 4/2005 Malloy
6,898,940 B2 5/2005 Gram et al.
6,916,200 B2 7/2005 Burris et al.
6,929,265 B2 8/2005 Holland et al.
6,929,508 B1 8/2005 Holland
6,939,169 B2 9/2005 Islam et al.
6,948,976 B2 9/2005 Goodwin et al.
6,971,912 B2 12/2005 Montena et al.
7,004,788 B2 2/2006 Montena
7,011,547 B1 3/2006 Wu
7,029,304 B2 4/2006 Montena
7,029,326 B2 4/2006 Montena
7,063,565 B2 6/2006 Ward
7,070,447 B1 7/2006 Montena
7,074,081 B2 7/2006 Hsia
7,086,897 B2 8/2006 Montena
7,097,499 B1 8/2006 Purdy
7,097,500 B2 8/2006 Montena
7,102,868 B2 9/2006 Montena
7,108,548 B2 9/2006 Burris et al.
7,114,990 B2 * 10/2006 Bence et al. ..... 439/583
7,118,416 B2 10/2006 Montena et al.
7,125,283 B1 10/2006 Lin
7,128,603 B2 10/2006 Burris et al.
7,128,605 B2 10/2006 Montena
7,131,867 B1 11/2006 Foster et al.
7,131,868 B2 11/2006 Montena
7,144,271 B1 12/2006 Burris et al.
7,147,509 B1 12/2006 Burris et al.
7,156,696 B1 1/2007 Montena
7,161,785 B2 1/2007 Chawgo
7,179,121 B1 2/2007 Burris et al.
7,186,127 B2 3/2007 Montena
7,189,113 B2 3/2007 Sattele et al.
7,198,507 B2 4/2007 Tusini
7,207,820 B1 4/2007 Montena
7,229,303 B2 6/2007 Vermoesen et al.
7,241,172 B2 7/2007 Rodrigues et al.
7,252,546 B1 8/2007 Holland
7,255,598 B2 8/2007 Montena et al.
7,264,503 B2 9/2007 Montena
7,299,520 B2 11/2007 Huang
7,299,550 B2 11/2007 Montena
7,300,309 B2 11/2007 Montena
7,309,255 B2 12/2007 Rodrigues
7,354,309 B2 4/2008 Palinkas
7,371,112 B2 5/2008 Burris et al.
7,371,113 B2 5/2008 Burris et al.
7,375,533 B2 5/2008 Gale
7,393,245 B2 7/2008 Palinkas et al.
7,404,737 B1 7/2008 Youtsey
7,442,081 B2 10/2008 Burke et al.
7,452,237 B1 11/2008 Montena
7,452,239 B2 11/2008 Montena
7,455,549 B2 11/2008 Rodrigues et al.
7,455,550 B1 11/2008 Sykes
7,462,068 B2 12/2008 Amidon
7,476,127 B1 1/2009 Wei
7,479,033 B1 1/2009 Sykes et al.
7,479,035 B2 1/2009 Bence et al.
7,480,991 B2 1/2009 Khemakhem et al.
7,488,210 B1 2/2009 Burris et al.
7,494,355 B2 2/2009 Hughes et al.
7,497,729 B1 3/2009 Wei
7,507,117 B2 3/2009 Amidon
7,513,795 B1 4/2009 Shaw
7,544,094 B1 6/2009 Paglia et al.
7,566,236 B2 7/2009 Malloy et al.
7,568,945 B2 8/2009 Chee et al.
7,607,942 B1 10/2009 Van Swearingen
7,644,755 B2 1/2010 Stoesz et al.
7,674,132 B1 3/2010 Chen
7,682,177 B2 3/2010 Berthet
7,727,011 B2 6/2010 Montena et al.
7,753,705 B2 7/2010 Montena
7,753,727 B1 7/2010 Islam et al.
7,792,148 B2 9/2010 Carlson et al.
7,794,275 B2 9/2010 Rodrigues
7,798,849 B2 9/2010 Montena
7,806,714 B2 10/2010 Williams et al.
7,806,725 B1 10/2010 Chen
7,811,133 B2 10/2010 Gray
7,824,216 B2 11/2010 Purdy
7,828,595 B2 11/2010 Mathews
7,828,596 B2 11/2010 Malak
7,830,154 B2 11/2010 Gale
7,833,053 B2 11/2010 Mathews
7,837,501 B2 11/2010 Youtsey
7,845,963 B2 12/2010 Gastineau
7,845,976 B2 12/2010 Mathews
7,845,978 B1 12/2010 Chen
7,850,487 B1 12/2010 Wei
7,857,661 B1 12/2010 Islam
7,874,870 B1 1/2011 Chen
7,887,354 B2 2/2011 Holliday
7,892,004 B2 2/2011 Hertzler et al.
7,892,005 B2 2/2011 Haube
7,892,024 B1 2/2011 Chen
7,927,135 B1 4/2011 Wlos
7,934,954 B1 5/2011 Chawgo et al.
7,950,958 B2 5/2011 Mathews
7,955,126 B2 6/2011 Bence et al.
7,972,158 B2 7/2011 Wild et al.
8,029,315 B2 10/2011 Purdy et al.
8,033,862 B2 10/2011 Radzil et al.
8,062,044 B2 11/2011 Montena et al.
8,062,063 B2 11/2011 Malloy et al.
8,075,337 B2 12/2011 Malloy et al.
8,075,338 B1 12/2011 Montena
8,075,339 B2 12/2011 Holliday
8,079,860 B1 12/2011 Zraik
8,113,875 B2 2/2012 Malloy et al.
8,152,551 B2 4/2012 Zraik
8,157,588 B1 4/2012 Rodrigues et al.
8,157,589 B2 4/2012 Krenceski et al.
8,167,635 B1 5/2012 Mathews
8,167,636 B1 5/2012 Montena
8,167,646 B1 5/2012 Mathews
8,172,612 B2 5/2012 Bence et al.
8,186,919 B2 5/2012 Blair
8,192,237 B2 6/2012 Purdy et al.
8,206,176 B2 6/2012 Islam
8,231,406 B2 7/2012 Burris et al.
8,231,412 B2 7/2012 Paglia et al.
8,287,320 B2 10/2012 Purdy et al.
8,313,345 B2 11/2012 Purdy
8,313,353 B2 11/2012 Purdy et al.
8,323,053 B2 12/2012 Montena
8,323,060 B2 12/2012 Purdy et al.
8,328,577 B1 12/2012 Lu
8,337,229 B2 12/2012 Montena
8,348,697 B2 1/2013 Zraik
8,366,481 B2 2/2013 Ehret et al.
8,376,769 B2 2/2013 Holland et al.

(56) References Cited

U.S. PATENT DOCUMENTS

| | | | | |
|---|---|---|---|---|
| 8,382,517 | B2 | 2/2013 | Mathews | |
| 8,398,421 | B2 | 3/2013 | Haberek et al. | |
| 8,414,322 | B2 | 4/2013 | Montena | |
| 8,444,445 | B2 | 5/2013 | Amidon et al. | |
| 8,469,740 | B2 | 6/2013 | Ehret et al. | |
| 8,475,205 | B2 | 7/2013 | Ehret et al. | |
| 8,480,430 | B2 | 7/2013 | Ehret et al. | |
| 8,480,431 | B2 | 7/2013 | Ehret et al. | |
| 8,485,845 | B2 | 7/2013 | Ehret et al. | |
| 8,506,325 | B2 | 8/2013 | Malloy et al. | |
| 8,517,763 | B2 | 8/2013 | Burris et al. | |
| 8,529,279 | B2 | 9/2013 | Montena | |
| 8,562,366 | B2 | 10/2013 | Purdy et al. | |
| 8,597,041 | B2 | 12/2013 | Purday et al. | |
| 2002/0013088 | A1 | 1/2002 | Rodrigues et al. | |
| 2002/0038720 | A1 | 4/2002 | Kai et al. | |
| 2003/0068924 | A1 | 4/2003 | Montena | |
| 2003/0214370 | A1 | 11/2003 | Allison et al. | |
| 2003/0224657 | A1 | 12/2003 | Malloy | |
| 2004/0013096 | A1 | 1/2004 | Marinier et al. | |
| 2004/0077215 | A1 | 4/2004 | Palinkas et al. | |
| 2004/0102089 | A1 | 5/2004 | Chee | |
| 2004/0209516 | A1 | 10/2004 | Burris et al. | |
| 2004/0219833 | A1 | 11/2004 | Burris et al. | |
| 2004/0229504 | A1 | 11/2004 | Liu | |
| 2005/0042919 | A1 | 2/2005 | Montena | |
| 2005/0208827 | A1 | 9/2005 | Burris et al. | |
| 2005/0233636 | A1 | 10/2005 | Rodrigues et al. | |
| 2006/0099853 | A1 | 5/2006 | Sattele et al. | |
| 2006/0110977 | A1 | 5/2006 | Matthews | |
| 2006/0154519 | A1 | 7/2006 | Montena | |
| 2006/0166552 | A1 | 7/2006 | Bence et al. | |
| 2006/0205272 | A1 | 9/2006 | Rodrigues | |
| 2006/0276079 | A1 | 12/2006 | Chen | |
| 2007/0026734 | A1 | 2/2007 | Bence et al. | |
| 2007/0049113 | A1 | 3/2007 | Rodrigues et al. | |
| 2007/0123101 | A1 | 5/2007 | Palinkas | |
| 2007/0155232 | A1 | 7/2007 | Burris et al. | |
| 2007/0175027 | A1 | 8/2007 | Khemakhem et al. | |
| 2007/0243759 | A1 | 10/2007 | Rodrigues et al. | |
| 2007/0243762 | A1 | 10/2007 | Burke et al. | |
| 2008/0102696 | A1 | 5/2008 | Montena | |
| 2008/0192674 | A1 | 8/2008 | Wang et al. | |
| 2008/0225783 | A1 | 9/2008 | Wang et al. | |
| 2008/0248689 | A1 | 10/2008 | Montena | |
| 2008/0289470 | A1 | 11/2008 | Aston | |
| 2009/0017803 | A1 | 1/2009 | Brilhart et al. | |
| 2009/0029590 | A1 | 1/2009 | Sykes et al. | |
| 2009/0098770 | A1* | 4/2009 | Bence et al. | 439/583 |
| 2009/0176396 | A1 | 7/2009 | Mathews | |
| 2010/0055978 | A1 | 3/2010 | Montena | |
| 2010/0081321 | A1 | 4/2010 | Malloy et al. | |
| 2010/0081322 | A1 | 4/2010 | Malloy et al. | |
| 2010/0105246 | A1 | 4/2010 | Burris et al. | |
| 2010/0233901 | A1 | 9/2010 | Wild et al. | |
| 2010/0233902 | A1 | 9/2010 | Youtsey | |
| 2010/0255720 | A1 | 10/2010 | Radzik et al. | |
| 2010/0255721 | A1 | 10/2010 | Purdy | |
| 2010/0279548 | A1 | 11/2010 | Montena et al. | |
| 2010/0297871 | A1 | 11/2010 | Haube | |
| 2010/0297875 | A1* | 11/2010 | Purdy et al. | 439/578 |
| 2011/0021072 | A1 | 1/2011 | Purdy | |
| 2011/0027039 | A1 | 2/2011 | Blair | |
| 2011/0053413 | A1 | 3/2011 | Mathews | |
| 2011/0086543 | A1 | 4/2011 | Alrutz | |
| 2011/0111623 | A1 | 5/2011 | Burris et al. | |
| 2011/0117774 | A1* | 5/2011 | Malloy et al. | 439/578 |
| 2011/0143567 | A1 | 6/2011 | Purdy et al. | |
| 2011/0230089 | A1 | 9/2011 | Amidon et al. | |
| 2011/0230091 | A1 | 9/2011 | Krenceski et al. | |
| 2011/0250789 | A1 | 10/2011 | Burris et al. | |
| 2012/0021642 | A1 | 1/2012 | Zraik | |
| 2012/0040537 | A1 | 2/2012 | Burris | |
| 2012/0045933 | A1 | 2/2012 | Youtsey | |
| 2012/0094530 | A1 | 4/2012 | Montena | |
| 2012/0094532 | A1 | 4/2012 | Montena | |
| 2012/0122329 | A1 | 5/2012 | Montena | |
| 2012/0129387 | A1 | 5/2012 | Holland et al. | |
| 2012/0145454 | A1 | 6/2012 | Montena | |
| 2012/0171894 | A1 | 7/2012 | Malloy et al. | |
| 2012/0196476 | A1 | 8/2012 | Haberek et al. | |
| 2012/0202378 | A1 | 8/2012 | Krenceski et al. | |
| 2012/0214342 | A1 | 8/2012 | Mathews | |
| 2012/0222302 | A1 | 9/2012 | Purdy et al. | |
| 2012/0225581 | A1 | 9/2012 | Amidon et al. | |
| 2012/0252263 | A1 | 10/2012 | Ehret et al. | |
| 2012/0270441 | A1 | 10/2012 | Bence et al. | |
| 2013/0034983 | A1 | 2/2013 | Purday et al. | |
| 2013/0065433 | A1 | 3/2013 | Burris | |
| 2013/0065435 | A1 | 3/2013 | Purdy et al. | |
| 2013/0072059 | A1 | 3/2013 | Purday et al. | |
| 2013/0102188 | A1 | 4/2013 | Montena | |
| 2013/0102189 | A1 | 4/2013 | Montena | |
| 2013/0102190 | A1 | 4/2013 | Chastain et al. | |
| 2013/0164975 | A1 | 6/2013 | Blake et al. | |
| 2013/0171869 | A1 | 7/2013 | Chastain et al. | |
| 2013/0171870 | A1 | 7/2013 | Chastain et al. | |
| 2013/0183857 | A1 | 7/2013 | Ehret et al. | |
| 2013/0337683 | A1 | 12/2013 | Chastain et al. | |
| 2014/0051285 | A1 | 2/2014 | Raley et al. | |

FOREIGN PATENT DOCUMENTS

| | | | |
|---|---|---|---|
| CN | 101060690.00 | A | 10/2007 |
| CN | 201149936.00 | Y | 11/2008 |
| CN | 201149937.00 | Y | 11/2008 |
| CN | 201178228.00 | Y | 1/2009 |
| CN | 201904508.00 | | 7/2011 |
| DE | 47931.00 | C | 10/1888 |
| DE | 102289.00 | C | 4/1899 |
| DE | 1117687.00 | B | 11/1961 |
| DE | 1191880.00 | | 4/1965 |
| DE | 1515398.00 | B1 | 4/1970 |
| DE | 2225764.00 | A1 | 12/1972 |
| DE | 2221936.00 | A1 | 11/1973 |
| DE | 2261973.00 | A1 | 6/1974 |
| DE | 3211008.00 | A1 | 10/1983 |
| DE | 9001608.40 | U1 | 4/1990 |
| DE | 4439852.00 | A1 | 5/1996 |
| DE | 19957518.00 | A1 | 9/2001 |
| EP | 116157.00 | A1 | 8/1984 |
| EP | 167738.00 | A2 | 1/1986 |
| EP | 0072104 | A1 | 2/1986 |
| EP | 0265276 | A2 | 4/1988 |
| EP | 0428424 | A2 | 5/1991 |
| EP | 1191268.00 | A1 | 3/2002 |
| EP | 1501159.00 | A1 | 1/2005 |
| EP | 1548898.00 | A1 | 6/2005 |
| EP | 1701410.00 | A2 | 9/2006 |
| FR | 2232846.00 | A1 | 1/1975 |
| FR | 2234680.00 | A2 | 1/1975 |
| FR | 2312918.00 | | 12/1976 |
| FR | 2462798.00 | A1 | 2/1981 |
| FR | 2494508.00 | A1 | 5/1982 |
| GB | 589697.00 | A | 6/1947 |
| GB | 1087228.00 | A | 10/1967 |
| GB | 1270846.00 | A | 4/1972 |
| GB | 1401373.00 | A | 7/1975 |
| GB | 2019665.00 | A | 10/1979 |
| GB | 2079549.00 | A | 1/1982 |
| GB | 2252677.00 | A | 8/1992 |
| GB | 2264201.00 | A | 8/1993 |
| GB | 2331634.00 | A | 5/1999 |
| GB | 2477479.00 | | 8/2010 |
| JP | 3074864.00 | | 1/2001 |
| JP | 2002-015823 | | 1/2002 |
| JP | 4503793.00 | B9 | 1/2002 |
| JP | 2002075556.00 | A | 3/2002 |
| JP | 2001102299.00 | | 4/2002 |
| JP | 3280369.00 | B2 | 5/2002 |
| KR | 2006100622526.00 | B1 | 9/2006 |
| TW | 427044.00 | B | 3/2001 |
| WO | 8700351 | | 1/1987 |
| WO | 0186756 | A1 | 11/2001 |

(56) References Cited

FOREIGN PATENT DOCUMENTS

| | | | |
|---|---|---|---|
| WO | 02069457 | A1 | 9/2002 |
| WO | 2004013883 | A2 | 2/2004 |
| WO | 2006081141 | A1 | 8/2006 |
| WO | 2010135181 | | 11/2010 |
| WO | 2011128665 | A1 | 10/2011 |
| WO | 2011128666 | A1 | 10/2011 |
| WO | 2012061379 | A2 | 5/2012 |

OTHER PUBLICATIONS

ARRIS1; Digicon AVL Connector. ARRIS Group Inc. [online]. 3 pages. [retrieved on Apr. 22, 2010]. Retrieved from the Internet:<URL: http://www.arrisi.com/special/digiconAVL.asp>.
ISR1; PCT/US2011/057939 Date of Mailing: Apr. 30, 2012 International Search Report and Written Opinion. pp. 8.
LIT10; Defendant's Disclosure of Preliminary Invalidity Contentions, Served Oct. 31, 2013, *PPC Broadband, Inc. d/b/a PPC* v. *Times Fiber Communications, Inc.*, United States District Court Northern district of New York, Civil Action No. 5:13-CV-0460-TJM-DEP, 48 pages.
LIT16; Report and Recommendation, Issued Dec. 5, 2013, *John Mezzalingua Associates, Inc., d/b/a PPC*, v. *Corning Gilbert, Inc.*, United States District Court Northern District of New York, Civil Action No. 5:12-CV-00911-GLS-DEP, 52 pages.
NOA1; Notice of Allowance (Mail Date: Feb. 24, 2012) for U.S. Appl. No. 13/033,127, filed Feb. 23, 2011.
NOA2; Notice of Allowance (Mail Date: Jan. 24, 2013) for U.S. Appl. No. 13/072,350.
NOA3; Notice of Alowance (Date mailed: Jun. 25, 2012) for U.S. Appl. No. 12/633,792, filed Dec. 8, 2009.
NOA4; Notice of Allowance (Mail Date Mar. 20, 2012) for U.S. Appl. No. 13/117,843, filed May 27, 2011.
OA1; Office Action mail date Mar. 29, 2013 for U.S. Appl. No. 13/712,470.
OA10; Final Office Action (Mail Date: Oct. 25, 2011) for U.S. Appl. No. 13/033,127, filed Feb. 23, 2011.
OA11; Office Action (Mail Date: Oct. 24, 2011) for U.S. Appl. No. 12/633,792, filed Dec. 8, 2009.
OA2; Office Action (Mail Date Mar. 6, 2013) for U.S. Appl. No. 13/726,330, filed Dec. 24, 2012.
OA3; Office Action (Mail Date Feb. 20, 2013) for U.S. Appl. No. 13/726,349, filed Dec. 24, 2012.
OA4; Office Action (Mail Date Feb. 20, 2013) for U.S. Appl. No. 13/726,339, filed Dec. 24, 2012.
OA5; Office Action (Mail Date Mar. 11, 2013) for U.S. Appl. No. 13/726,347, filed Dec. 24, 2012.
OA6; Office Action (Mail Date Feb. 20, 2013) for U.S. Appl. No. 13/726,356, filed Dec. 24, 2012.
OA7; Office Action (mail date Apr. 12, 2013) for U.S. Appl. No. 13/712,498, filed Dec. 12, 2012.
OA8; Office Action (mail date Jun. 11, 2013) for U.S. Appl. No. 13/860,964, filed Apr. 11, 2013.
OA9; Office Action (Mail Date: Jun. 2, 2011) for U.S. Appl. No. 13/033,127, filed Feb. 23, 2011.
RES1; Response dated Jun. 24, 2011 to Office Action (Mail Date: Jun. 2, 2011) for U.S. Appl. No. 13/033,127, filed Feb. 23, 2011.
TECHDOC1; Philips, NXP, "PDCCH message information content for persistent scheduling," R1-081506, Agenda Item: 6.1.3, 3GPP TSG RAN WG1 Meeting #52bis, Shenzhen, China, Mar. 31-Apr. 4, 2008, 3 pages.
TECHDOC10; PPC Product Guide, 2008.
TECHDOC2; NTT DoCoMo, Inc. "UL semi-persistent resource deactivation," R2-082483 (resubmission of R2-081859), Agenda Item: 5.1.1.8, 3GPP TSG RAN WG2 #62, Kansas City, MO, USA, May 5-9, 2008, 2 pages.
TECHDOC3; Panasonic, "Configuration for semi-persistent scheduling," R2-081575, Agenda Item: 5.1.1.8, 3GPP TSG RAN WG2 #61bis, Shenzhen, China, Mar. 31-Apr. 4, 2008, 4 pages.
TECHDOC4; Panasonic, "Remaining issues on Persistent scheduling," R2-083311, derived from R2-082228 and R2-082229, Agenda Item: 6.1.1.8, 3GPP TSG RAN WG2 #62bis, Warsaw, Poland, Jun. 30-Jul. 4, 2008, 4 pages.
TECHDOC7; Nokia Corporation, Nokia Siemens Networks, "Persistent Scheduling for DL," R2-080683 (RS-080018), 3GPP TSG-RAN WG2 Meeting #61, Agenda Item: 5.1.1.8, Sorrento, Italy, Feb. 11-15, 2008, 6 pages.
TECHDOC8; Panasonic, "SPS activation and release," R1-084233, 3GPP TSG-RAN WG1 Meeting #55, Prague, Czech Republic, Nov. 10-14, 2008, 6 pages.
TECHDOC9; PCT International, Inc., Compression Connectors Installation Guide, Aug. 3, 2009.
TechDoc11; NTT DoCoMo, Alcatel, Cingular Wireless, CMCC, Ericsson, Fujitsu, Huawei, LG Electronics, Lucent Technologies, Mitsubishi Electric, Motorola, NEC, Nokia, Nortel Networks, Orange, Panasonic, Philips, Qualcomm Europe, Samsung, Sharp Siemens, Telecom Italia, Telefonica, TeliaSonera, T-Mobile, Vodafone, "Proposed Study Item on Evolved UTRA and UTRAN," RP-040461, Agenda Item: 8.12, TSG-RAN Meeting #26, Athens, Greece, Dec. 8-10, 2004, 5 pages.
TECHSPEC1A; "3rd Generation Partnership Project; Technical Specification Group Radio Access Network; Requirements for Evolved UTRA (E-UTRA) and Evolved UTRAN (E-UTRAN) (Release 7)," Technical Report, 3GPP TR 125.913 V7.3.0, Mar. 2006, 18 pages.
TECHSPEC2A; "3rd Generation Partnership Project; Technical Specification Group Radio Access Network; Evolved Universal Terrestrial Radio Access (E-UTRA) and Evolved Universal Terrestrial Radio Access Network (E-UTRAN); Overall description; Stage 2 (Release 8)," Technical Specification, 3GPP TS 36.300 V8.5.0, May 2008, 134 pages.
TECHSPEC3A; "3rd Generation Partnership Project; Technical Specification Group Radio Access Network; Evolved Universal Terrestrial Radio Access (E-UTRA) Medium Access Control (MAC) protocol specification (Release 8)," Technical Specification, 3GPP TS 36.321 V8.2.0, May 2008, 32 pages.
TECHSPEC4A; "3rd Generation Partnership Project; Technical Specification Group Radio Access Netowrk; Evolved Universal Terrestrial Radio Access (E-UTRA); Physical layer procedures (Release 8)," Technical Specification, 3GPP TS 36.213 V8.4.0, Sep. 2008, 60 pages.
TECHSPEC5A; Society of Cable Telecommunications Engineers, Engineering Committee, Interface Practices Subcommittee; American National Standard; ANSI/SCTE Jan. 2006; "Specification for "F" Port, Female, Outdoor". Published Jan. 2006. 9 pages.
TECHSPEC6A; Society of Cable Telecommunications Engineers, Engineering Committee, Interface Practices Subcommittee; American National Standard; ANSI/SCTE Feb. 2006; "Specification for "F" Port, Female, Indoor". Published Feb. 2006. 9 pages.
Patent Application No. GB1109575.9 Examination Report Under Section 18(3); Date of Report: Jun. 23, 2011. 3 pp.
Patent No. ZL2010202597847; Evaluation Report of Utility Model Patent; Date of Report: Sep. 2, 2011. 8 pages. (Chinese version with English Translation (10 pages) provided).
PCT/US2010/034870; International Filing Date May 14, 2010. International Search Report and Written Opinion. Date of Mailing: Nov. 30, 2010. 7 pages.

* cited by examiner

CONNECTOR HAVING A COUPLER-BODY CONTINUITY MEMBER

PRIORITY CLAIM

This application is a continuation of, and claims the benefit and priority of, U.S. patent application Ser. No. 13/712,470, filed on Dec. 12, 2012, which is a continuation of, and claims the benefit and priority of, U.S. patent application Ser. No. 13/016,114, filed on Jan. 28, 2011, now U.S. Pat. No. 8,337,229 B2, which is a non-provisional of, and claims the benefit and priority of, U.S. Provisional Patent Application Ser. No. 61/412,611 filed on Nov. 11, 2010. The entire contents of such applications are hereby incorporated by reference.

CROSS REFERENCE TO RELATED APPLICATIONS

This application is related to the following commonly-owned, co-pending patent applications: (a) U.S. patent application Ser. No. 14/092,003, filed on Nov. 27, 2013; (b) U.S. patent application Ser. No. 14/092,103, filed on Nov. 27, 2013; (c) U.S. patent application Ser. No. 13/971,147 filed on Aug. 20, 2013; (d) U.S. patent application Ser. No. 13/913,043 filed on Jun 7, 2013; and (e) U.S. patent application Ser. No. 13/758,586 filed on Feb. 4, 2013.

FIELD OF TECHNOLOGY

The following disclosure relates generally to the field of connectors for coaxial cables. More particularly, to embodiments of a coaxial cable connector having a continuity member that extends electrical continuity through the connector.

BACKGROUND

Broadband communications have become an increasingly prevalent form of electromagnetic information exchange and coaxial cables are common conduits for transmission of broadband communications. Connectors for coaxial cables are typically connected onto complementary interface ports to electrically integrate coaxial cables to various electronic devices. In addition, connectors are often utilized to connect coaxial cables to various communications modifying equipment such as signal splitters, cable line extenders and cable network modules.

To help prevent the introduction of electromagnetic interference, coaxial cables are provided with an outer conductive shield. In an attempt to further screen ingress of environmental noise, typical connectors are generally configured to contact with and electrically extend the conductive shield of attached coaxial cables. Moreover, electromagnetic noise can be problematic when it is introduced via the connective juncture between an interface port and a connector. Such problematic noise interference is disruptive where an electromagnetic buffer is not provided by an adequate electrical and/or physical interface between the port and the connector.

Accordingly, there is a need in the field of coaxial cable connectors for an improved connector design.

SUMMARY

The present invention provides an apparatus for use with coaxial cable connections that offers improved reliability.

A first general aspect relates generally to a coaxial cable connector comprising a connector body attached to a post, wherein the connector body has a first end and a second end, a port coupling element rotatable about the post, the port coupling element separated from the connector body by a distance, and a continuity element positioned between the port coupling element and the connector body proximate the second end of the connector body, wherein the continuity element establishes and maintains electrical continuity between the connector body and the port coupling element.

A second general aspect relates generally to a coaxial cable connector comprising a connector body attached to a post, the connector body having a first end and a second end, wherein the connector body includes an annular outer recess proximate the second end, a port coupling element rotatable about the post, wherein the port coupling element has an internal lip, and a continuity element having a first surface axially separated from a second surface, the first surface contacting the internal lip of the port coupling element and the second surface contacting the outer annular recess of the connector body, wherein the continuity element facilitates grounding of a coaxial cable through the connector.

A third general aspect relates generally to a coaxial cable connector comprising a connector body attached to a post, the connector body having a first end and opposing second end, wherein the connector body includes an annular outer recess proximate the second end, a port coupling element rotatable about the post, wherein the port coupling element has an internal lip, and a means for establishing and maintaining physical and electrical communication between the connector body and the port coupling element.

A fourth general aspect relates generally to a coaxial cable connector comprising a connector body attached to a post, the connector body having a first end and a second end, wherein the connector body includes an annular outer recess proximate the second end, a port coupling element rotatable about the post, wherein the port coupling element has an inner surface, and a continuity element having a first surface and a second surface, the first surface contacting the inner surface of the port coupling element and the second surface contacting the outer annular recess of the connector body, wherein the continuity element establishes and maintains electrical communication between the port coupling element and the connector body in a radial direction.

A fifth general aspect relates generally to a method for facilitating grounding of a coaxial cable through the connector, comprising providing a coaxial cable connector, the coaxial cable connector including: a connector body attached to a post, wherein the connector body has a first end and a second end, and a port coupling element rotatable about the post, the port coupling element separated from the connector body by a distance; and disposing a continuity element positioned between the port coupling element and the connector body proximate the second end of the connector body, wherein the continuity element establishes and maintains electrical continuity between the connector body and the port coupling element.

The foregoing and other features of the invention will be apparent from the following more particular description of various embodiments of the invention.

BRIEF DESCRIPTION OF THE DRAWINGS

Some of the embodiments of this invention will be described in detail, with reference to the following figures, wherein like designations denote like members, wherein.

DETAILED DESCRIPTION OF DRAWINGS

Figure 1:
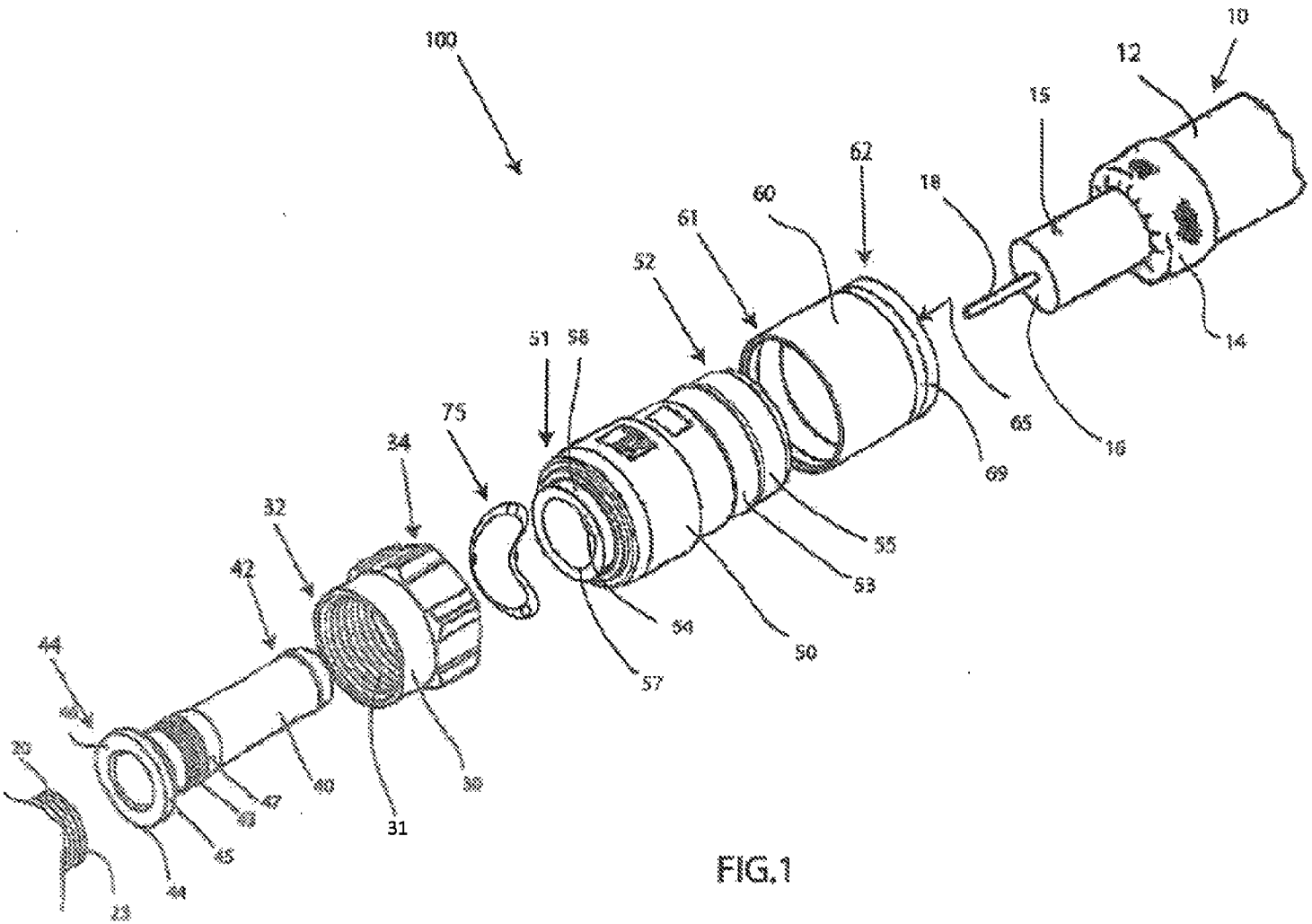
FIG. 1 depicts an exploded perspective view of an embodiment of a connector having a first embodiment of a nut-body continuity element.

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a", "an" and "the" include plural referents, unless the context clearly dictates otherwise.

Referring to the drawings, FIG. 1 depicts one embodiment of a connector 100. The connector 100 may include a coaxial cable 10 having a protective outer jacket 12, a conductive grounding shield 14 or shields 14, an interior dielectric 16 (potentially surrounding a conductive foil layer 15), and a center conductor 18. The coaxial cable 10 may be prepared by removing the protective outer jacket 12 and drawing back the conductive grounding shield 14 to expose a portion of the interior dielectric 16 (potentially surrounding a conductive foil layer 15). Further preparation of the embodied coaxial cable 10 may include stripping the dielectric 16 (and potential conductive foil layer 15) to expose a portion of the center conductor 18. The protective outer jacket 12 is intended to protect the various components of the coaxial cable 10 from damage which may result from exposure to dirt or moisture and from corrosion. Moreover, the protective outer jacket 12 may serve in some measure to secure the various components of the coaxial cable 10 in a contained cable design that protects the cable 10 from damage related to movement during cable installation. The conductive grounding shield 14 may be comprised of conductive materials suitable for providing an electrical ground connection. Various embodiments of the shield 14 may be employed to screen unwanted noise. For instance, the shield 14 may comprise several conductive strands formed in a continuous braid around the dielectric 16 (potentially surrounding a conductive foil layer 15). Combinations of foil and/or braided strands may be utilized wherein the conductive shield 14 may comprise a foil layer, then a braided layer, and then a foil layer. Those in the art will appreciate that various layer combinations may be implemented in order for the conductive grounding shield 14 to effectuate an electromagnetic buffer helping to prevent ingress of environmental noise that may disrupt broadband communications. Furthermore, there may be more than one grounding shield 14, such as a tri-shield or quad shield cable, and there may also be flooding compounds protecting the shield 14. The dielectric 16 may be comprised of materials suitable for electrical insulation. It should be noted that the various materials of which all the various components of the coaxial cable 10 are comprised should have some degree of elasticity allowing the cable 10 to flex or bend in accordance with traditional broadband communications standards, installation methods and/or equipment. It should further be recognized that the radial thickness of the coaxial cable 10, protective outer jacket 12, conductive grounding shield 14, interior dielectric 16 and/or center conductor 18 may vary based upon generally recognized parameters corresponding to broadband communication standards and/or equipment.

The conductive foil layer 15 may comprise a layer of foil wrapped or otherwise positioned around the dielectric 16, thus the conductive foil layer 15 may surround and/or encompass the dielectric 16. For instance, the conductive foil layer 15 may be positioned between the dielectric 16 and the shield 14. In one embodiment, the conductive foil layer 15 may be bonded to the dielectric 16. In another embodiment, the conductive foil layer 15 may be generally wrapped around the dielectric 16. The conductive foil layer 15 may provide a continuous uniform outer conductor for maintaining the coaxial condition of the coaxial cable 10 along its axial length. The coaxial cable 10 having, inter alia, a conductive foil layer 15 may be manufactured in thousands of feet of lengths. Furthermore, the conductive foil layer 15 may be manufactured to a nominal outside diameter with a plus minus tolerance on the diameter, and may be a wider range than what may normally be achievable with machined, molded, or cast components. The outside diameter of the conductive foil layer 15 may vary in dimension down the length of the cable 10, thus its size may be unpredictable at any point along the cable 10. Due to this unpredictability, the contact between the post 40 and the conductive foil layer 15 may not be sufficient or adequate for conductivity or continuity throughout the connector 100. Thus, a nut-body continuity element 75 may be placed between the nut 30 and the connector body 50 to allow continuity and/or continuous physical and electrical contact or communication between the nut 30 and the connector body 50. Continuous conductive and electrical continuity between the nut 30 and the connector body 50 can be established by the physical and electrical contact between the connector body 50 and the nut-body continuity element 75, wherein the nut-body continuity element 75 is simultaneously in physical and electrical contact with the nut 30. While operably configured, electrical continuity may be established and maintained throughout the connector 100 and to interface port 20 via the conductive foil layer 15 which contacts the conductive grounding shield 14, which contacts the connector body 50, which contacts the nut-body continuity element 75, which contacts the nut 30, the nut 30 being advanced onto interface port 20. Alternatively, electrical continuity can be established and maintained throughout the connector 100 via the conductive foil layer 15, which contacts the post 40, which contacts the connector body 50, which contacts the nut-body continuity element 75, which contacts the nut 30, the nut 30 being advanced onto interface port 20.

Referring further to FIG. 1, the connector 100 may make contact with a coaxial cable interface port 20. The coaxial cable interface port 20 includes a conductive receptacle 22 for receiving a portion of a coaxial cable center conductor 18 sufficient to make adequate electrical contact. The coaxial cable interface port 20 may further comprise a threaded exterior surface 24. However, various embodiments may employ a smooth surface, as opposed to threaded exterior surface. In addition, the coaxial cable interface port 20 may comprise a mating edge 26. It should be recognized that the radial thickness and/or the length of the coaxial cable interface port 20 and/or the conductive receptacle 22 may vary based upon generally recognized parameters corresponding to broadband communication standards and/or equipment. Moreover, the pitch and height of threads which may be formed upon the threaded exterior surface 24 of the coaxial cable interface port 20 may also vary based upon generally recognized parameters corresponding to broadband communication standards and/or equipment. Furthermore, it should be noted that the interface port 20 may be formed of a single conductive material, multiple conductive materials, or may be configured with both conductive and non-conductive materials corresponding to the port's 20 electrical interface with a connector 100. For example, the threaded exterior surface may be fabricated from a conductive material, while the material comprising the mating edge 26 may be non-conductive or vice versa. However, the conductive receptacle 22 should be formed of a conductive material. Further still, it will be understood by those of ordinary skill that the interface port 20 may be embodied by a connective interface component of a communications modifying device such as a signal splitter, a cable line extender, a cable network module and/or the like.

With continued reference to FIG. 1, an embodiment of the connector 100 may further comprise a nut 30 with threads 31, a post 40, a connector body 50, a fastener member 60, and a nut-body continuity element 75. The nut-body continuity element 75 should be formed of a conductive material. Such conductive materials may include, but are not limited to conductive polymers, conductive plastics, conductive elastomers, conductive elastomeric mixtures, composite materials having conductive properties, metal, soft metals, conductive rubber, and/or the like and/or any operable combination thereof. The nut-body continuity element 75 may be resilient, flexible, elastic, etc., or may be rigid and/or semi-rigid. The nut-body continuity element 75 may have a circular, rectangular, square, or any appropriate geometrically dimensioned cross-section. For example, the nut-body continuity element 75 may have a flat rectangular cross-section similar to a metal washer or wave washer. The nut-body continuity element 75 may also be a conductive element, conductive member, continuity element, a conductive ring, a conductive wave ring, a continuity ring, a continuity wave ring, a resilient member, and the like.

Figure 2B:
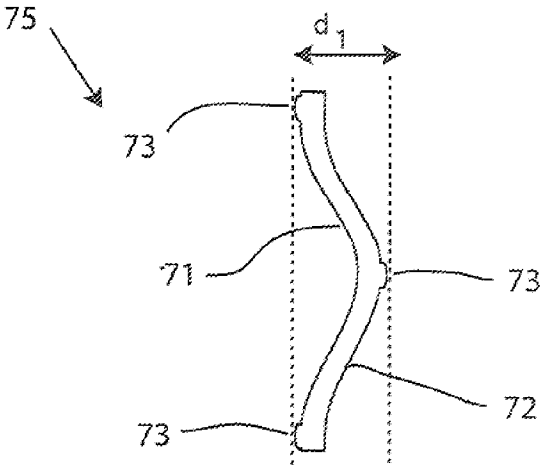
FIG. 2B depicts a second side view of a first embodiment of a nut-body continuity element.
Figure 2A:
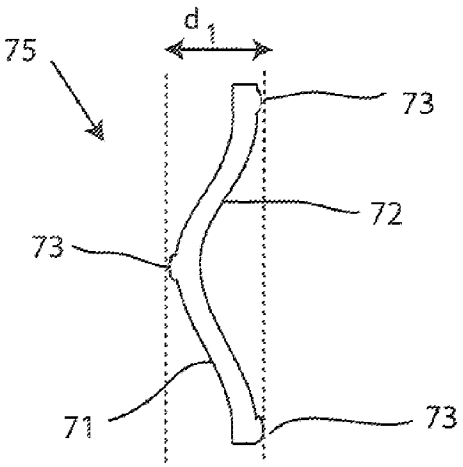
FIG. 2A depicts a first side view of a first embodiment of a nut-body continuity element.
Figure 2C:
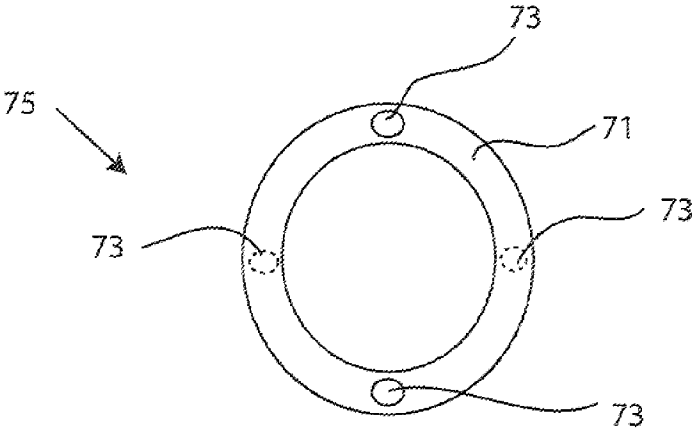
FIG. 2C depicts a front view of a first embodiment of a nut-body continuity element.
Figure 2D:
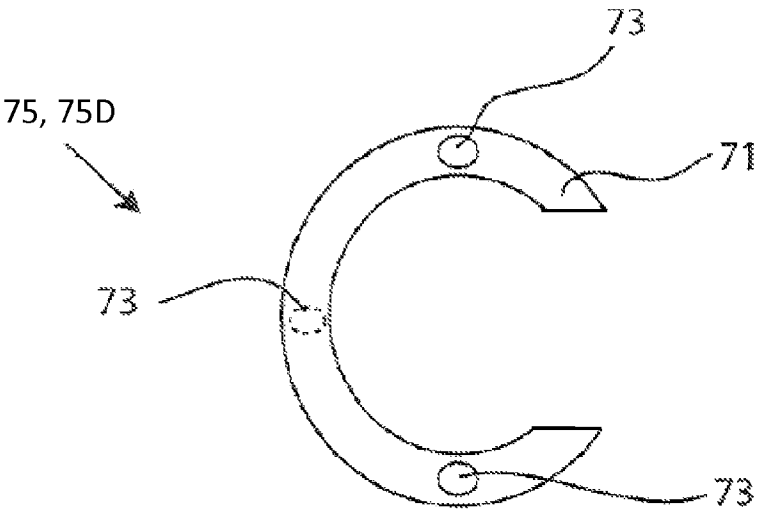
FIG. 2D depicts a front view of another embodiment of a continuity element.
Figure 2E:
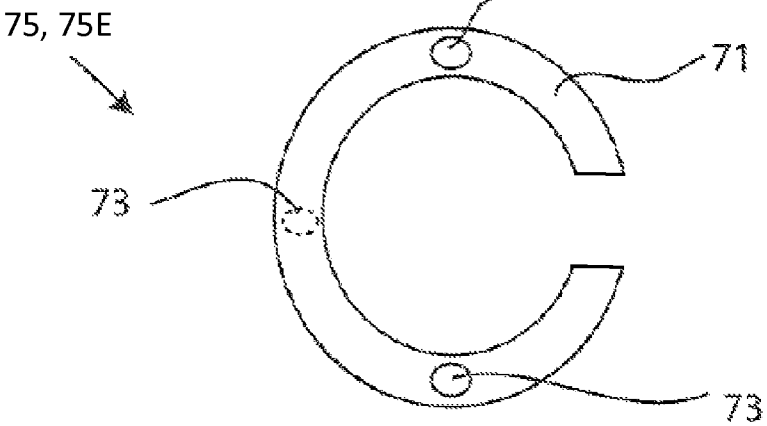
FIG. 2E depicts a front view of yet another embodiment of a continuity element.

Referring to the drawings, FIGS. 2A-2C depict further embodiments of a nut-body continuity element 75, specifically, embodiments of a structure and/or design of a nut-body continuity element 75. For example, the nut-body continuity element 75 may comprise a substantially circinate torus or toroid structure. Moreover, nut-body continuity element 75 may have a slight bend to provide axial separation between contact points. For instance, the point on first surface 71 of the nut-body continuity element 75 contacting the nut 30 may be an axial distance, $d_1$, away from the point on the second surface 72 of the nut-body continuity element 75 contacting the connector body 50. To facilitate contact with the connector body 50 and with the nut 30, the nut-body continuity element 75 may have one or more bumps 73 located on the surface of the nut-body continuity element 75. Bumps 73 may be any protrusion from the surface of the nut-body continuity element 75 that can facilitate the contact of the nut 30 and the connector body 50. The surface of the nut-body continuity element 75 can comprise a first surface 71 and a second surface 72; bumps 73 may be located on both the first surface 71 of the nut-body continuity element 75 and the second surface 72 of the nut-body continuity element 75, or just one of the first surface 71 or second surface 72. In some embodiments, the nut-body continuity element 75 does not have any bumps 73 positioned on the surface, and relies on smooth, flat contact offered by the first surface 71 and/or second surface 72. Because of the shape and design of the nut-body continuity element 75 (i.e. because of the bended configuration), the nut-body continuity element 75 should make contact with the nut 30 at two or more points along the first surface 71, and should also make contact with the connector body 50 at two or more points along the second surface 72. Depending on the angle of curvature of the bend, the nut-body continuity element 75 may contact the nut 30 and the connector body 50 at multiple or single locations along the first surface 71 and second surface 72 of the nut-body continuity element 75. The angle of curvature of the bend of the nut-body continuity element 75 may vary, including a nut-body continuity element 75 with little to no axial separation.

Furthermore, a bended configuration of the nut-body continuity element 75 can allow a portion of the nut-body continuity element 75 to physically contact the nut 30 and another portion of the nut-body continuity element 75 to contact the connector body 50 in a biasing relationship. For instance, the bend in the nut-body continuity element 75 can allow deflection of the element when subjected to an external force, such as a force exerted by the nut 30 (e.g. internal lip 36) or the connector body 50 (e.g. outer annular recess 56). The biasing relationship between the nut 30, the connector body 50, and the nut-body continuity element 75, evidenced by the deflection of the nut-body continuity element 75, establishes and maintains constant contact between the nut 30, the connector body 50, and the nut-body continuity element 75. The constant contact may establish and maintain electrical continuity through a connector 100. A bend in the nut-body continuity element 75 may also be a wave, a compression, a deflection, a contour, a bow, a curve, a warp, a deformation, and the like. Those skilled in the art should appreciate the various resilient shapes and variants of elements the nut-body continuity element 75 may encompass to establish and maintain electrical communication between the nut 30 and the connector body 50.

Figure 3:
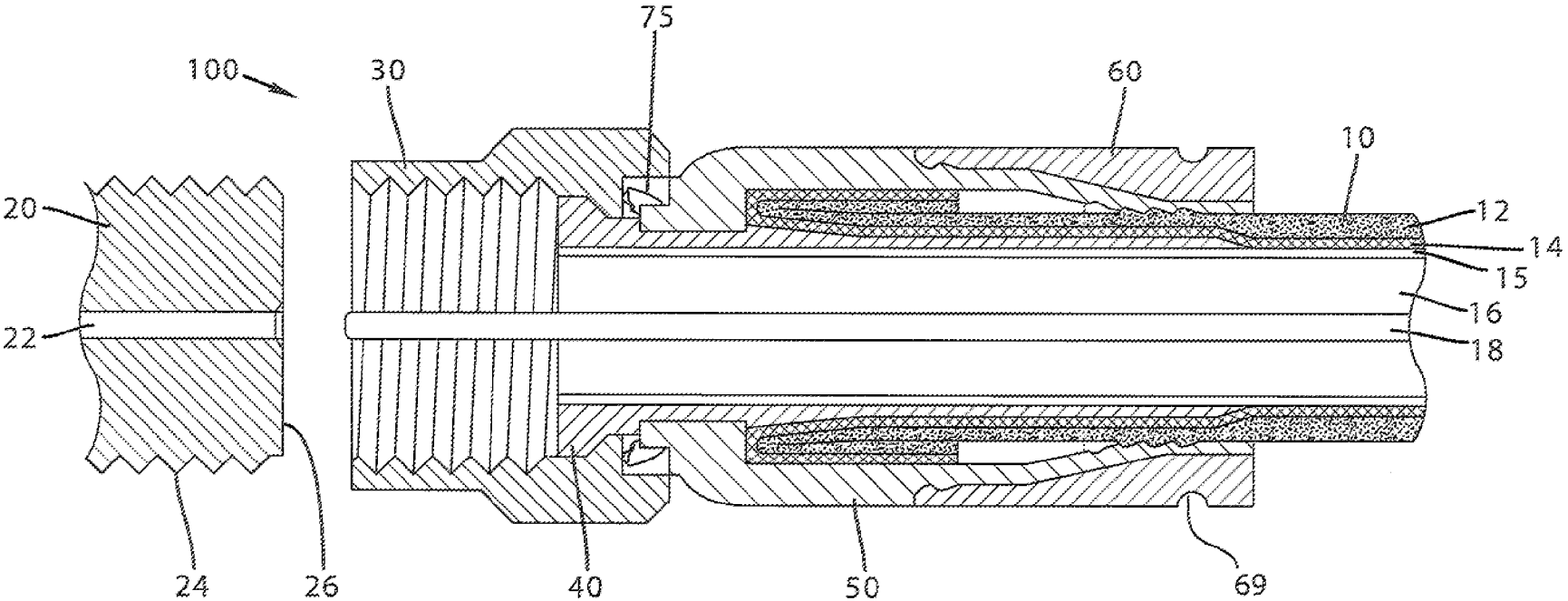
FIG. 3 depicts a sectional side view of an embodiment of a connector having a first embodiment of a nut-body continuity element.

Referring still to the drawings, FIG. 3 depicts an embodiment of a connector 100 having a nut-body continuity element 75. The nut-body continuity element 75 may be disposed and/or placed between the nut 30 and the connector body 50. For example, the nut-body continuity element 75 may be configured to cooperate with the annular recess 56 proximate the second end 54 of connector body 50 and the cavity 38 extending axially from the edge of second end 34 and partially defined and bounded by an outer internal wall 39 of threaded nut 30 (see FIG. 6) such that the continuity element 75 may make contact with and/or reside contiguous with the annular recess 56 of connector body 50 and may make contact with and/or reside contiguous with the mating edge 37 of threaded nut 30. Moreover, a portion of the nut-body continuity element 75 can reside inside and/or contact the cavity 38 proximate a second end 32 of the nut, while another portion of the same nut-body continuity element 75 contacts an outer annular recess 56 proximate the second end 54. Alternatively, the nut-body continuity element 75 may have a radial relationship with the post 40, proximate the second 44 of the post 40. For example, the nut-body continuity element 75 may be radially disposed a distance above the post 40. However, the placement of the nut-body continuity element 75 in all embodiments does not restrict or prevent the nut 30 (port coupling element) from freely rotating, in particular, rotating about the stationary post 40. In some embodiments, the nut-body continuity element 75 may be configured to rotate or spin with the nut 30, or against the nut 30. In many embodiments, the nut-body continuity element 75 is stationary with respect to the nut 30. In other embodiments, the nut-body continuity element 75 may be press-fit into position between the nut 30 and the connector body 50. Furthermore, those skilled in the art would appreciate that the nut-body continuity element 75 may be fabricated by extruding, coating, molding, injecting, cutting, turning, elastomeric batch processing, vulcanizing, mixing, stamping, casting, and/or the like and/or any combination thereof in order to provide efficient production of the component.

Furthermore, the nut-body continuity element 75 need not be radially disposed 360° around the post 40, or extend, reside contiguous, etc., 360° around the outer annular recess 56 or cavity 38. For example, the nut-body continuity element 75 may be radially disposed only a portion of 360° around the post 40, or extend only a portion of 360° around the outer annular recess 56 or cavity 38. Specifically, the nut-body continuity element 75 may be formed in the shape of a half circle, crescent, half moon, semi-circle, C-shaped, and the like. Such C-shape can provide, for example, the C-shape of continuity element 75D or 75E. As long as the nut-body continuity element 75 physically contacts the nut 30 and the connector body 50, physical and electrical continuity may be established and maintained. In a semi-circular embodiment of the nut-body continuity element 75, the first surface 71 of the nut-body continuity element 75 can physically contact the internal lip 36 of nut 30 at least once, while simultaneously contacting the outer annular recess 56 of the connector body 50 at least once. Thus, electrical continuity between the connector body 50 and the nut 30 may be established and maintained by implementation of various embodiments of the nut-body continuity element 75.

For instance, through various implementations of embodiments of the nut-body continuity element 75, physical and electrical communication or contact between the nut 30 and the nut-body continuity element 75, wherein the nut-body continuity element 75 simultaneously contacts the connector body 50 may help transfer the electricity or current from the post 40 (i.e. through conductive communication of the grounding shield 14) to the nut 30 and to the connector body 50, which may ground the coaxial cable 10 when the nut 30 is in electrical or conductive communication with the coaxial cable interface port 20. In many embodiments, the nut-body continuity element 75 axially contacts the nut 30 and the connector body 50. In other embodiments, the nut-body continuity element 75 radially contacts the nut 30 and the connector body 50.

Figure 4:
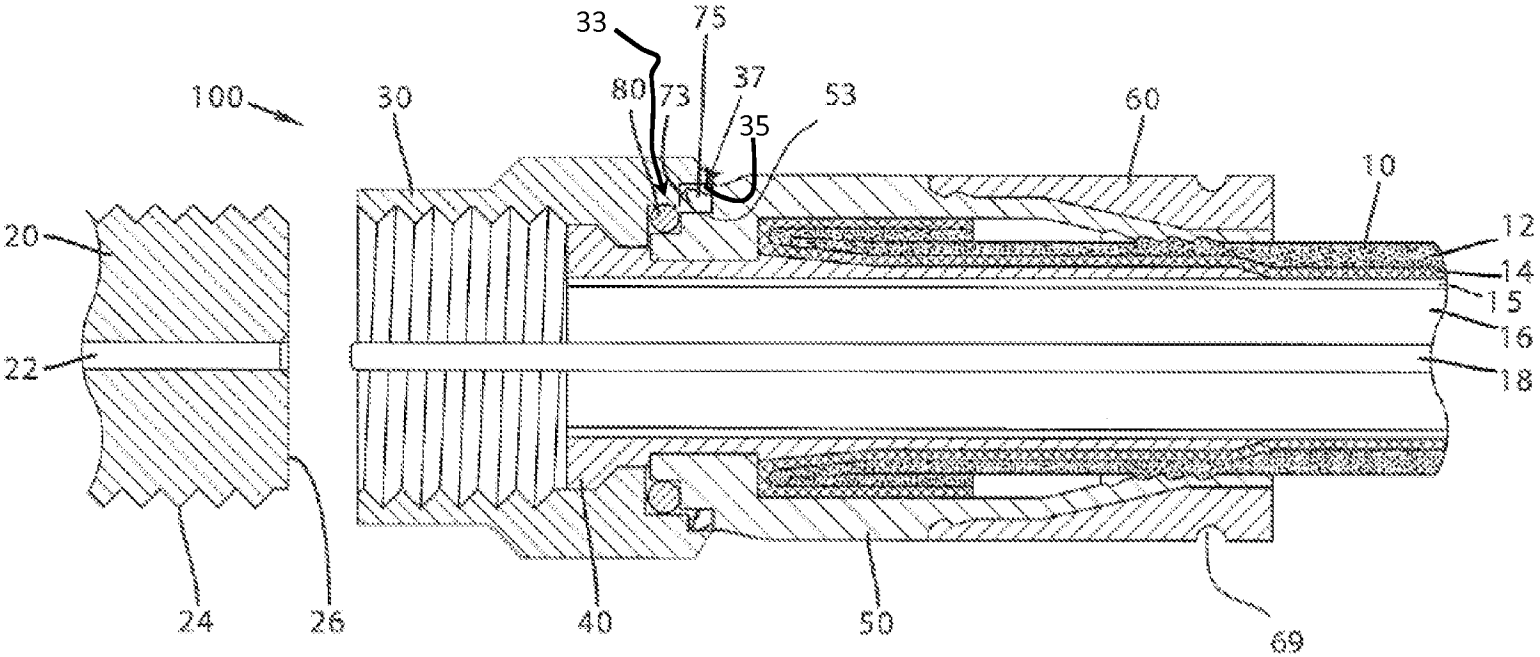
FIG. 4 depicts a sectional side view of an embodiment of a connector having a first embodiment of a nut-body continuity element and a conductive element.
Figure 5:
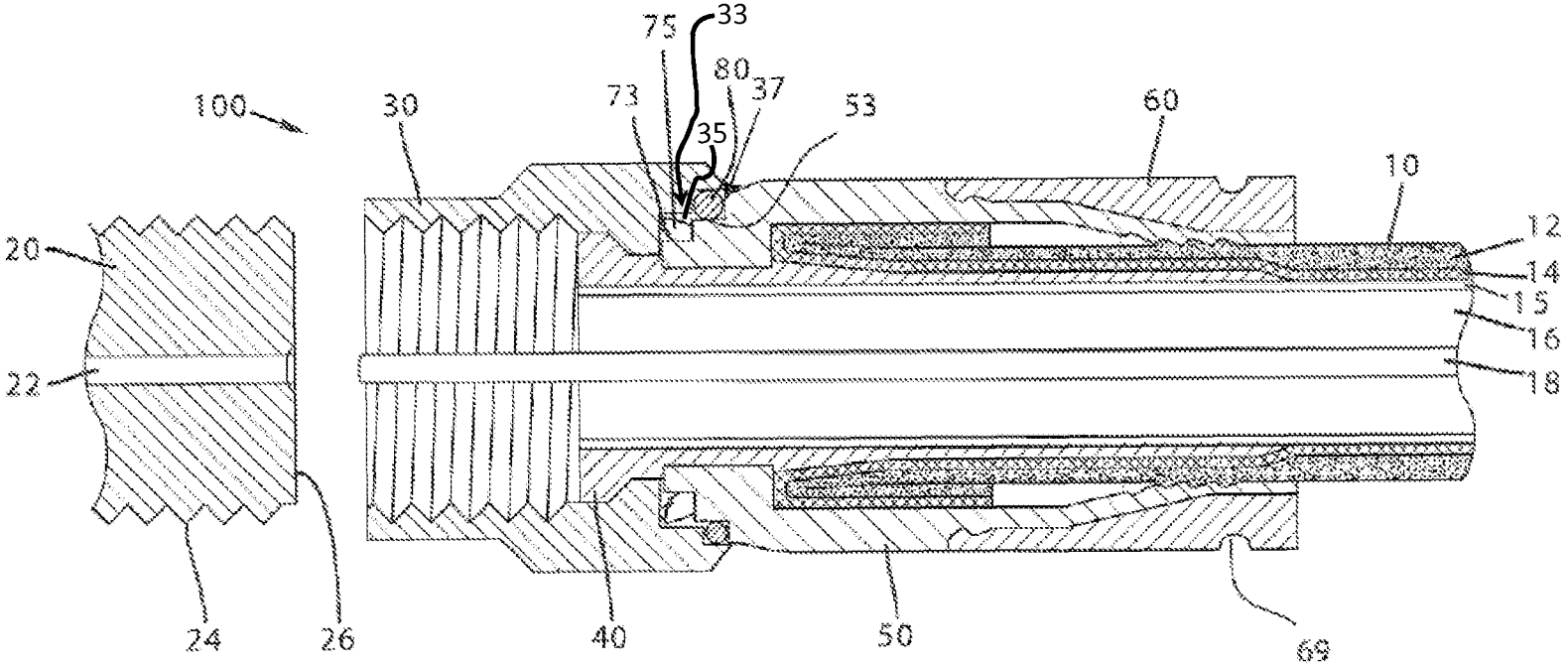
FIG. 5 depicts a sectional side view of an embodiment of a connector having a first embodiment of a nut-body continuity element inboard of a conductive element.

FIG. 4 depicts an embodiment of the connector 100 which may comprise a nut 30, a post 40, a connector body 50, a fastener member 60, a nut-body continuity element 75, and a connector body conductive member 80 proximate the second end 54 of the connector body 50. The nut-body continuity element 75 may reside in additional cavity 35 proximate the second end 32 of the nut 30 and additional annular recess 53 proximate the second end 54 of the connector body 50. The connector body conductive member 80 should be formed of a conductive material. Such materials may include, but are not limited to conductive polymers, plastics, elastomeric mixtures, composite materials having conductive properties, soft metals, conductive rubber, and/or the like and/or any workable combination thereof. The connector body conductive member 80 may comprise a substantially circinate torus or toroid structure, or other ring-like structure. For example, an embodiment of the connector body conductive member 80 may be an O-ring configured to cooperate with the annular recess 56 proximate the second end 54 of connector body 50 and the cavity 38 extending axially from the edge of second end 34 and partially defined and bounded by an outer internal wall 39 of threaded nut 30 (see FIG. 6) such that the connector body conductive O-ring 80 may make contact with and/or reside contiguous with the annular recess 56 of connector body 50 and outer internal wall 39 of threaded nut 30 when operably attached to post 40 of connector 100. The connector body conductive member 80 may facilitate an annular seal between the threaded nut 30 and connector body 50 thereby providing a physical barrier to unwanted ingress of moisture and/or other environmental contaminates. Moreover, the connector body conductive member 80 may further facilitate electrical coupling of the connector body 50 and threaded nut 30 by extending therebetween an unbroken electrical circuit. In addition, the connector body conductive member 80 may facilitate grounding of the connector 100, and attached coaxial cable (shown in FIG. 1), by extending the electrical connection between the connector body 50 and the threaded nut 30. Furthermore, the connector body conductive member 80 may effectuate a buffer preventing ingress of electromagnetic noise between the threaded nut 30 and the connector body 50. It should be recognized by those skilled in the relevant art that the connector body conductive member 80 may be manufactured by extruding, coating, molding, injecting, cutting, turning, elastomeric batch processing, vulcanizing, mixing, stamping, casting, and/or the like and/or any combination thereof in order to provide efficient production of the component. Therefore, the combination of the connector body conductive member 80 and the nut-body continuity element 75 may further electrically couple the nut 30 and the connector body 50 to establish and maintain electrical continuity throughout connector 100. However, the positioning and location of these components may swap. For instance, FIG. 5 depicts an embodiment of a connector 100 having a nut-body continuity element 75 inboard of connector body conductive member 80.

Figure 6:
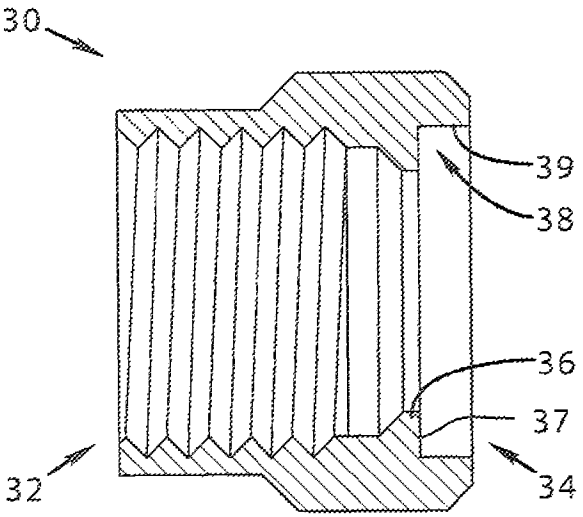
FIG. 6 depicts a sectional side view of an embodiment of a nut.

With additional reference to the drawings, FIG. 6 depicts a sectional side view of an embodiment of a nut 30 having a first end 32 and opposing second end 34. The nut 30 (or port coupling element, coupling element, coupler) may be rotatably secured to the post 40 to allow for rotational movement about the post 40. The nut 30 may comprise an internal lip 36 located proximate the second end 34 and configured to hinder axial movement of the post 40 (shown in FIG. 7). The lip 36 may include a mating edge 37 which may contact the post 40 while connector 100 is operably configured. Furthermore, the threaded nut 30 may comprise a cavity 38 extending axially from the edge of second end 34 and partial defined and bounded by the internal lip 36. The cavity 38 may also be partially defined and bounded by an outer internal wall 39. The threaded nut 30 may be formed of conductive materials facilitating grounding through the nut 30. Accordingly the nut 30 may be configured to extend an electromagnetic buffer by electrically contacting conductive surfaces of an interface port 20 when a connector 100 (shown in FIG. 3) is advanced onto the port 20. In addition, the threaded nut 30 may be formed of non-conductive material and function only to physically secure and advance a connector 100 onto an interface port 20. Moreover, the threaded nut 30 may be formed of both conductive and non-conductive materials. For example the internal lip 36 may be formed of a polymer, while the remainder of the nut 30 may be comprised of a metal or other conductive material. In addition, the threaded nut 30 may be formed of metals or polymers or other materials that would facilitate a rigidly formed body. Manufacture of the threaded nut 30 may include casting, extruding, cutting, turning, tapping, drilling, injection molding, blow molding, or other fabrication methods that may provide efficient production of the component. Those in the art should appreciate the various embodiments of the nut 30 may also comprise a coupler member having no threads, but being dimensioned for operable connection to a corresponding to an interface port, such as interface port 20.

Additionally, nut 30 may contain an additional cavity 35, formed similarly to cavity 38. In some embodiments that include an additional cavity 35, a secondary internal lip 33 should be formed to provide a surface for the contact and/or interference with the nut-body continuity element 75. For example, the nut-body continuity element 75 may be configured to cooperate with the additional annular recess 53 proximate the second end 54 of connector body 50 and the additional cavity 35 extending axially from the edge of second end 34 and partially defined and bounded by the secondary internal lip 33 of threaded nut 30 (see FIGS. 5-6) such that the nut-body continuity element 75 may make contact with and/or reside contiguous with the additional annular recess 53 of connector body 50 and the secondary internal lip 33 of threaded nut 30 (see FIG. 4). In some embodiments, there may be an additional recess, 35, and 53; however, the nut-body continuity element 75 may be positioned as embodied in FIG. 5.

Figure 7:
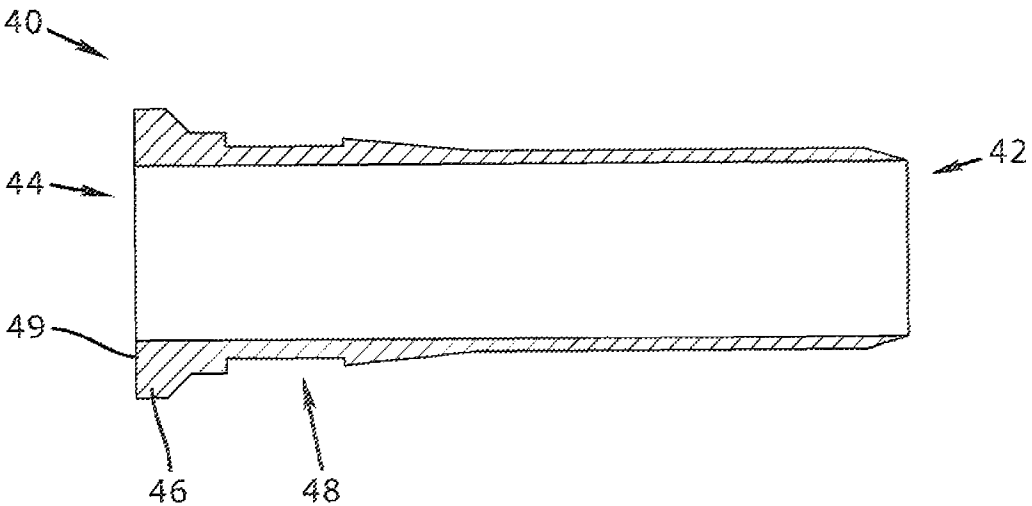
FIG. 7 depicts a sectional side view of an embodiment of a post.

With further reference to the drawings, FIG. 7 depicts a sectional side view of an embodiment of a post 40 in accordance with the present invention. The post 40 may comprise a first end 42 and opposing second end 44. Furthermore, the post 40 may comprise a flange 46 operably configured to contact internal lip 36 of threaded nut 30 (shown in FIG. 6) thereby facilitating the prevention of axial movement of the post beyond the contacted internal lip 36. Further still, an embodiment of the post 40 may include a surface feature 48 such as a shallow recess, detent, cut, slot, or trough. Additionally, the post 40 may include a mating edge 49. The mating edge 49 may be configured to make physical and/or electrical contact with an interface port 20 or mating edge member (shown in FIG. 1) or O-ring 70 (shown in FIGS. 11-12). The post 40 should be formed such that portions of a prepared coaxial cable 10 including the dielectric 16, conductive foil layer 15, and center conductor 18 (shown in FIGS. 1 and 2) may pass axially into the first end 42 and/or through the body of the post 40. Moreover, the post 40 should be dimensioned such that the post 40 may be inserted into an end of the prepared coaxial cable 10, around the conductive foil layer surrounding the dielectric 16, and under the protective outer jacket 12 and conductive grounding shield 14. Accordingly, where an embodiment of the post 40 may be inserted into an end of the prepared coaxial cable 10 under the drawn back conductive grounding shield 14 substantial physical and/or electrical contact with the shield 14 may be accomplished thereby facilitating grounding through the post 40. The post 40 may be formed of metals or other conductive materials that would facilitate a rigidly formed body. In addition, the post 40 may also be formed of non-conductive materials such as polymers or composites that facilitate a rigidly formed body. In further addition, the post may be formed of a combination of both conductive and non-conductive materials. For example, a metal coating or layer may be applied to a polymer of other non-conductive material. Manufacture of the post 40 may include casting, extruding, cutting, turning, drilling, injection molding, spraying, blow molding, or other fabrication methods that may provide efficient production of the component.

Figure 8:
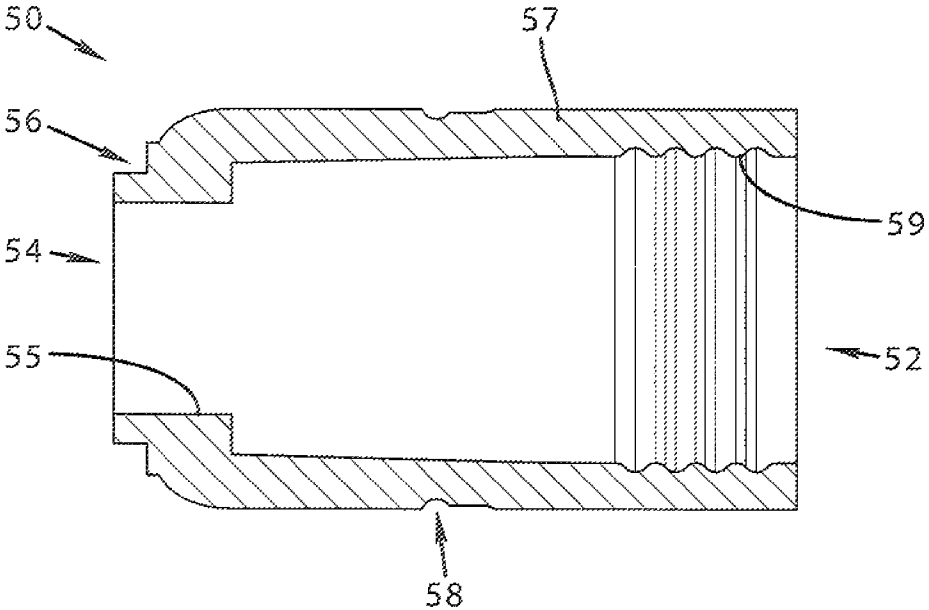
FIG. 8 depicts a sectional side view of an embodiment of a connector body.

With continued reference to the drawings, FIG. 8 depicts a sectional side view of a connector body 50. The connector body 50 may comprise a first end 52 and opposing second end 54. Moreover, the connector body 50 may include an internal annular lip 55 configured to mate and achieve purchase with the surface feature 48 of post 40 (shown in FIG. 7). In addition, the connector body 50 may include an outer annular recess 56 located proximate the second end 54. Furthermore, the connector body may include a semi-rigid, yet compliant outer surface 57, wherein the surface 57 may include an annular detent 58. The outer surface 57 may be configured to form an annular seal when the first end 52 is deformably compressed against a received coaxial cable 10 by a fastener member 60 (shown in FIG. 3). Further still, the connector body 50 may include internal surface features 59, such as annular serrations formed proximate the first end 52 of the connector body 50 and configured to enhance frictional restraint and gripping of an inserted and received coaxial cable 10. The connector body 50 may be formed of materials such as, polymers, bendable metals or composite materials that facilitate a semi-rigid, yet compliant surface 57. Further, the connector body 50 should be formed of conductive materials, or a combination of conductive and non-conductive materials such that electrical continuity can be established between the connector body 50 and the nut 30, facilitated by the nut-body continuity element 75. Manufacture of the connector body 50 may include casting, extruding, cutting, turning, drilling, injection molding, spraying, blow molding, or other fabrication methods that may provide efficient production of the component.

Additionally, the connector body 50 may contain an additional annular recess 53, formed similarly to outer annular recess 56. In some embodiments, the additional annular recess 53 may provide a surface for the contact and/or interference with the nut-body continuity element 75. For example, the nut-body continuity element 75 may be configured to cooperate with the additional annular recess 53 proximate the second end 54 of connector body 50 and the additional cavity 35 extending axially from the edge of second end 34 and partially defined and bounded by the secondary internal lip 33 of threaded nut 30 (see FIGS. 5-6) such that the nut-body continuity element 75 may make contact with and/or reside contiguous with the annular recess 53 of connector body 50 and the secondary internal lip 33 of threaded nut 30 (see FIG. 4). In some embodiments, there may be an additional recess, 35, and 53; however, the nut-body continuity element 75 may be positioned as embodied in FIG. 5.

Figure 9:
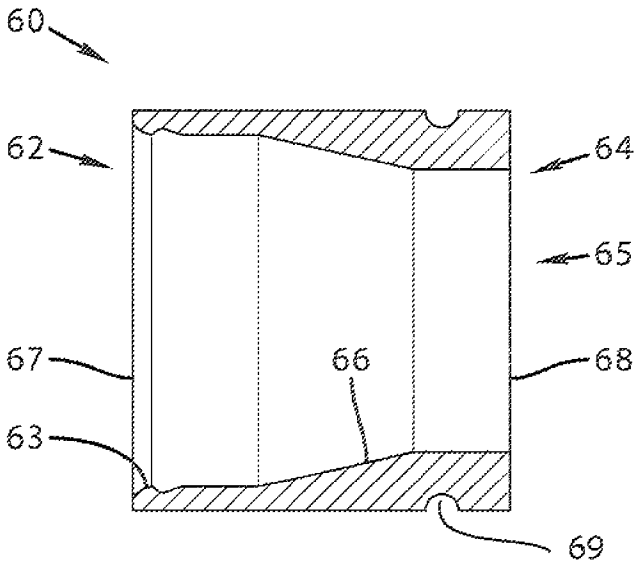
FIG. 9 depicts a sectional side view of an embodiment of a fastener member.

Referring further to the drawings, FIG. 9 depicts a sectional side view of an embodiment of a fastener member 60 in accordance with the present invention. The fastener member 60 may have a first end 62 and opposing second end 64. In addition, the fastener member 60 may include an internal annular protrusion 63 located proximate the first end 62 of the fastener member 60 and configured to mate and achieve purchase with the annular detent 58 on the outer surface 57 of connector body 50 (shown in FIG. 5). Moreover, the fastener member 60 may comprise a central passageway 65 defined between the first end 62 and second end 64 and extending axially through the fastener member 60. The central passageway 65 may comprise a ramped surface 66 which may be positioned between a first opening or inner bore 67 having a first diameter positioned proximate with the first end 62 of the fastener member 60 and a second opening or inner bore 68 having a second diameter positioned proximate with the second end 64 of the fastener member 60. The ramped surface 66 may act to deformably compress the inner surface 57 of a connector body 50 when the fastener member 60 is operated to secure a coaxial cable 10 (shown in FIG. 3). Additionally, the fastener member 60 may comprise an exterior surface feature 69 positioned proximate with the second end 64 of the fastener member 60. The surface feature 69 may facilitate gripping of the fastener member 60 during operation of the connector 100 (see FIG. 3). Although the surface feature is shown as an annular detent, it may have various shapes and sizes such as a ridge, notch, protrusion, knurling, or other friction or gripping type arrangements. It should be recognized, by those skilled in the requisite art, that the fastener member 60 may be formed of rigid materials such as metals, polymers, composites and the like. Furthermore, the fastener member 60 may be manufactured via casting, extruding, cutting, turning, drilling, injection molding, spraying, blow molding, or other fabrication methods that may provide efficient production of the component.

Figure 10:
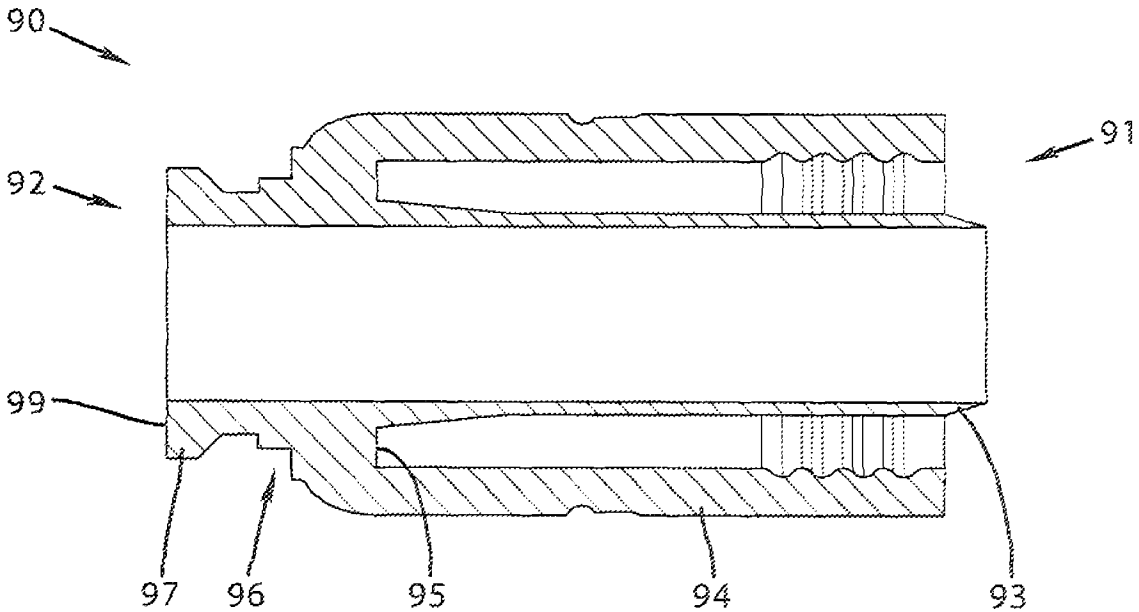
FIG. 10 depicts a sectional side view of an embodiment of a connector body having an integral post.

Referring still further to the drawings, FIG. 10 depicts a sectional side view of an embodiment of an integral post connector body 90 in accordance with the present invention. The integral post connector body 90 may have a first end 91 and opposing second end 92. The integral post connector body 90 physically and functionally integrates post and connector body components of an embodied connector 100 (shown in FIG. 1). Accordingly, the integral post connector body 90 includes a post member 93. The post member 93 may render connector operability similar to the functionality of post 40 (shown in FIG. 7). For example, the post member 93 of integral post connector body 90 may include a mating edge 99 configured to make physical and/or electrical contact with an interface port 20 (shown in FIG. 1) or mating edge member or O-ring 70 (shown in FIGS. 11-12). The post member 93 of integral should be formed such that portions of a prepared coaxial cable 10 including the dielectric 16, conductive foil layer 15, and center conductor 18 (shown in FIG. 1) may pass axially into the first end 91 and/or through the post member 93. Moreover, the post member 93 should be dimensioned such that a portion of the post member 93 may be inserted into an end of the prepared coaxial cable 10, around the dielectric 16 and conductive foil layer 15, and under the protective outer jacket 12 and conductive grounding shield 14 or shields 14. Further, the integral post connector body 90 includes a connector body surface 94. The connector body surface 94 may render connector 100 operability similar to the functionality of connector body 50 (shown in FIG. 8). Hence, inner connector body surface 94 should be semi-rigid, yet compliant. The outer connector body surface 94 may be configured to form an annular seal when compressed against a coaxial cable 10 by a fastener member 60 (shown in FIG. 3). In addition, the integral post connector body 90 may include an interior wall 95. The interior wall 95 may be configured as an unbroken surface between the post member 93 and outer connector body surface 94 of integral post connector body 90 and may provide additional contact points for a conductive grounding shield 14 of a coaxial cable 10. Furthermore, the integral post connector body 90 may include an outer recess formed proximate the second end 92. Further still, the integral post connector body 90 may comprise a flange 97 located proximate the second end 92 and operably configured to contact internal lip 36 of threaded nut 30 (shown in FIG. 6) thereby facilitating the prevention of axial movement of the integral post connector body 90 with respect to the threaded nut 30, yet still allowing rotational movement of the axially secured nut 30. The integral post connector body 90 may be formed of materials such as, polymers, bendable metals or composite materials that facilitate a semi-rigid, yet compliant outer connector body surface 94. Additionally, the integral post connector body 90 may be formed of conductive or non-conductive materials or a combination thereof. Manufacture of the integral post connector body 90 may include casting, extruding, cutting, turning, drilling, injection molding, spraying, blow molding, or other fabrication methods that may provide efficient production of the component.

Figure 11:
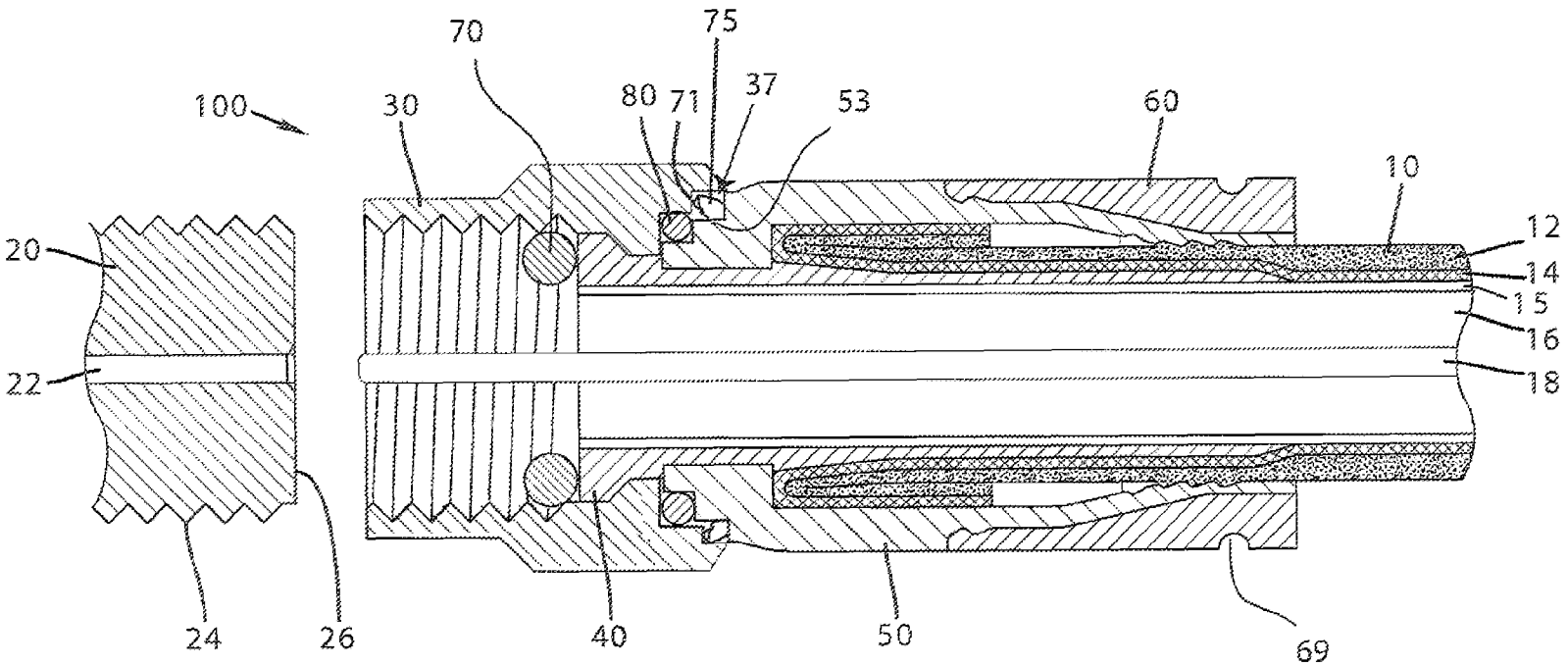
FIG. 11 depicts a sectional side view of an embodiment of a connector configured having a first embodiment of a nut-body continuity element with more than one continuity element proximate a second end of a post.
Figure 12:
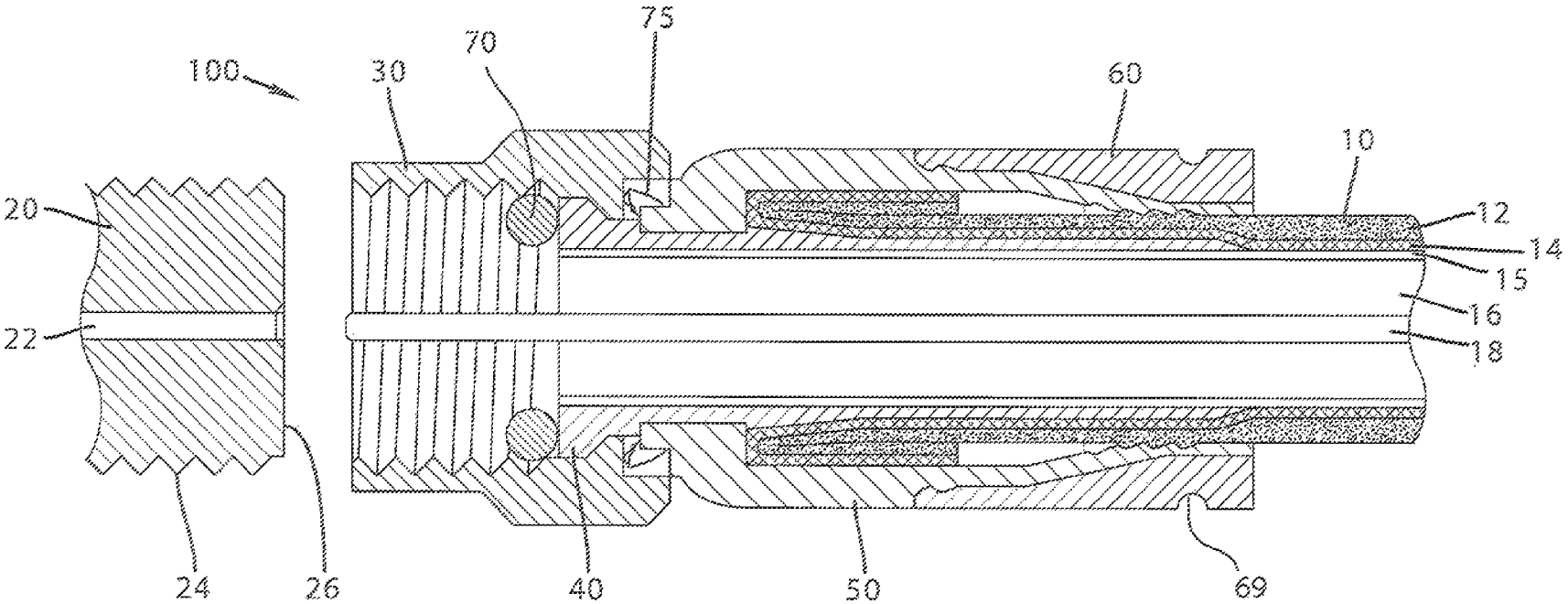
FIG. 12 depicts a sectional side view of an embodiment of a connector configured with a conductive member proximate a second end of a connector body, and a first embodiment of a nut-body continuity element.
Figure 13:
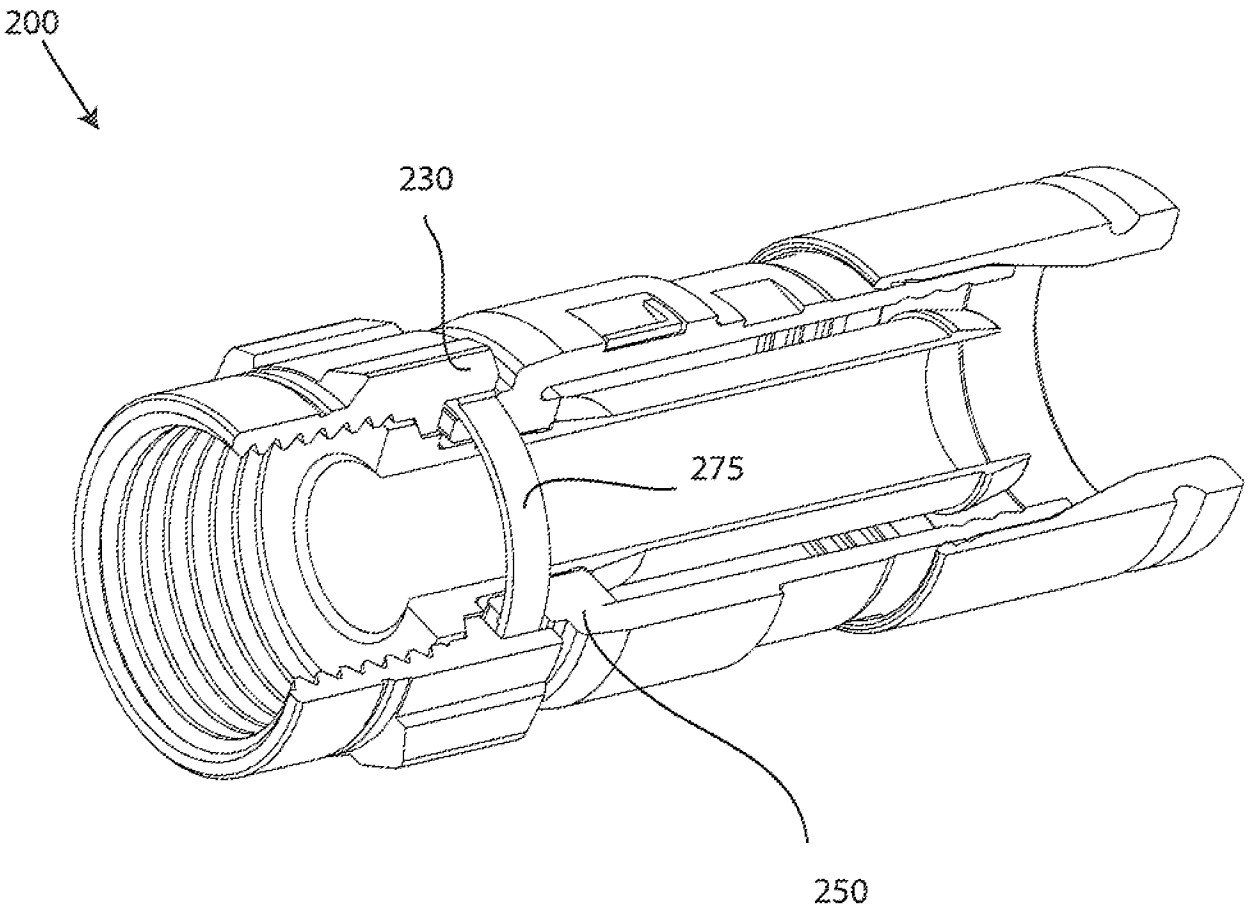
FIG. 13 depicts a perspective cut away view of an embodiment of a connector having a second embodiment of a nut-body continuity element.
Figure 15:
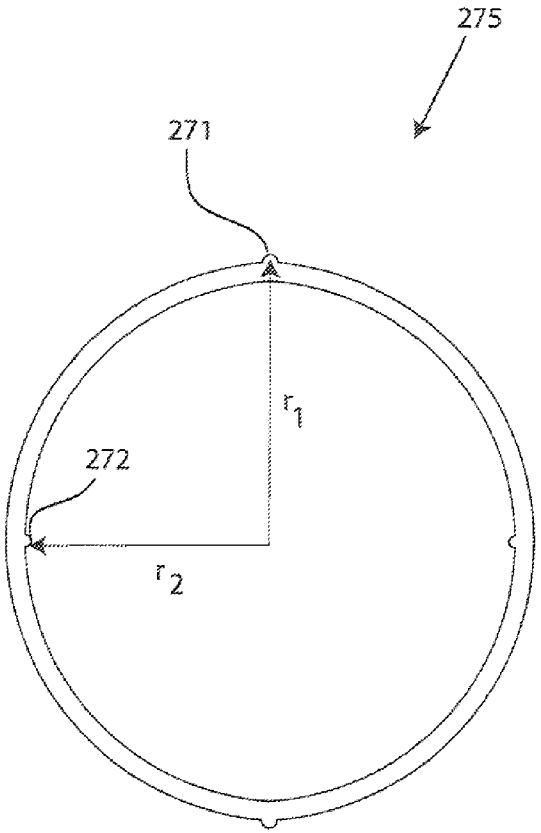
FIG. 15 depicts a front view of a second embodiment of a nut-body continuity element.
Figure 14:
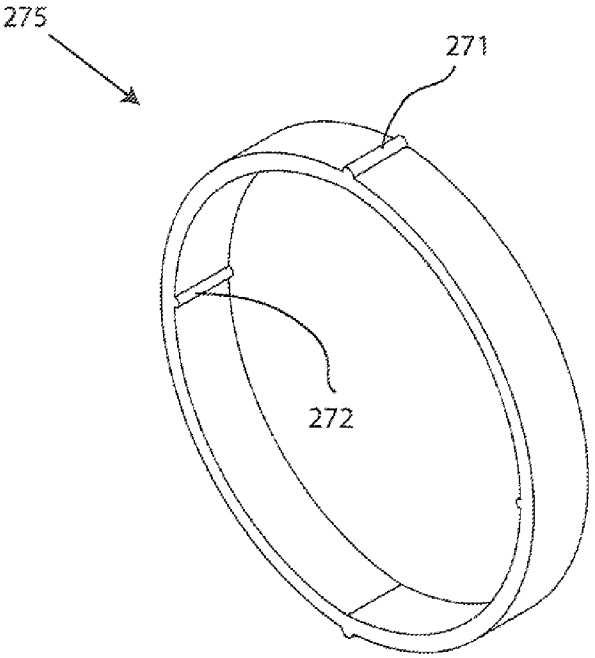
FIG. 14 depicts a perspective view of a second embodiment of a nut-body continuity element.
Figure 16:
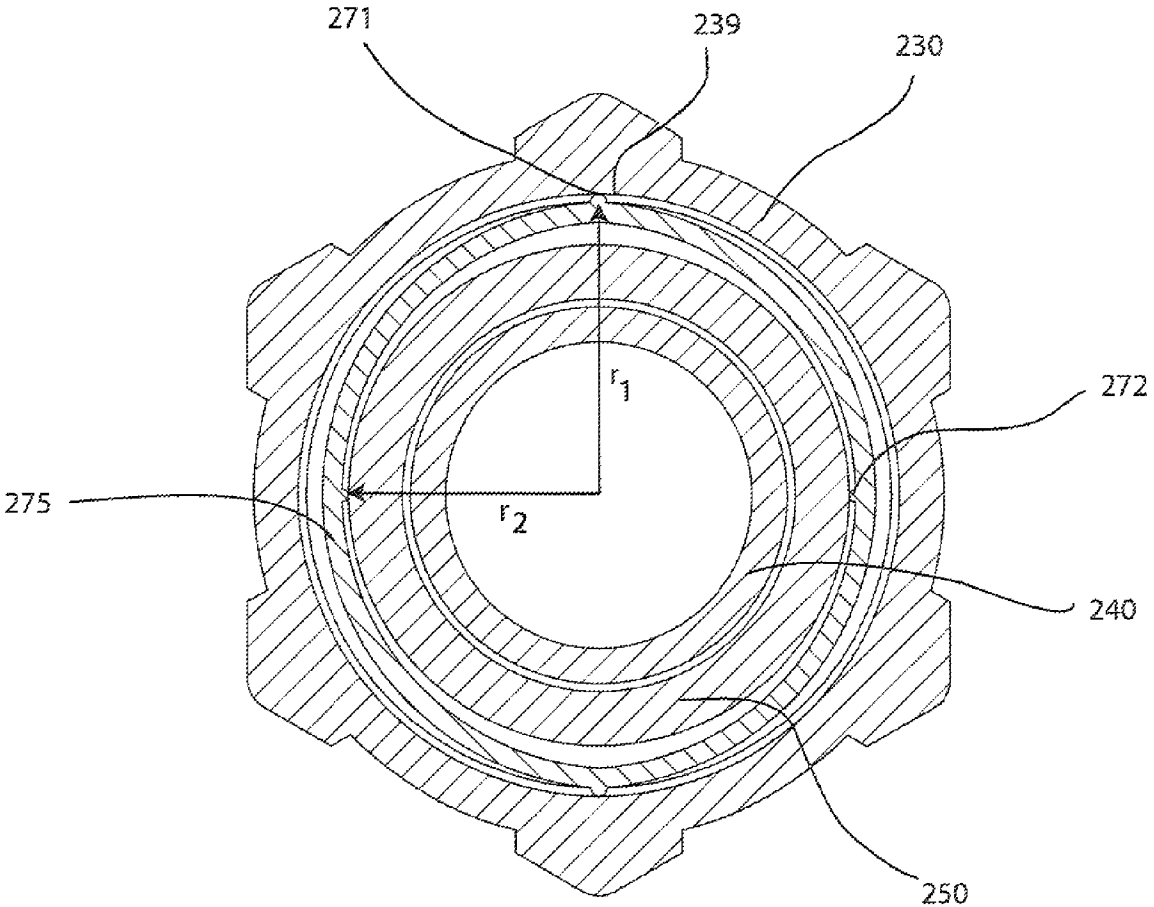
FIG. 16 depicts a cross-sectional end view of an embodiment of a connector having a second embodiment of a nut-body continuity element.

With continued reference to the drawings, FIG. 11 depicts a sectional side view of an embodiment of a connector 100 configured with a mating edge conductive member 70 proximate a second end 44 of a post 40, and a nut-body continuity element 75 located proximate a second end 54 of the connector body 50, and a connector body conductive member 80 (as described supra). The mating edge conductive member 70 should be formed of a conductive material. Such materials may include, but are not limited to conductive polymers, conductive plastics, conductive elastomers, conductive elastomeric mixtures, composite materials having conductive properties, soft metals, conductive rubber, and/or the like and/or any operable combination thereof. The mating edge conductive member 70 may comprise a substantially circinate torus or toroid structure adapted to fit within the internal threaded portion of threaded nut 30 such that the mating edge conductive member 70 may make contact with and/or reside continuous with a mating edge 49 of a post 40 when operably attached to post 40 of connector 100. For example, one embodiment of the mating edge conductive member 70 may be an O-ring. The mating edge conductive member 70 may facilitate an annular seal between the threaded nut 30 and post 40 thereby providing a physical barrier to unwanted ingress of moisture and/or other environmental contaminates. Moreover, the mating edge conductive member 70 may facilitate electrical coupling of the post 40 and threaded nut 30 by extending therebetween an unbroken electrical circuit. In addition, the mating edge conductive member 70 may facilitate grounding of the connector 100, and attached coaxial cable (shown in FIG. 3), by extending the electrical connection between the post 40 and the threaded nut 30. Furthermore, the mating edge conductive member 70 may effectuate a buffer preventing ingress of electromagnetic noise between the threaded nut 30 and the post 40. The mating edge conductive member or O-ring 70 may be provided to users in an assembled position proximate the second end 44 of post 40, or users may themselves insert the mating edge conductive O-ring 70 into position prior to installation on an interface port 20 (shown in FIG. 1). Those skilled in the art would appreciate that the mating edge conductive member 70 may be fabricated by extruding, coating, molding, injecting, cutting, turning, elastomeric batch processing, vulcanizing, mixing, stamping, casting, and/or the like and/or any combination thereof in order to provide efficient production of the component. FIG. 12 depicts an embodiment of a connector 100 having a mating edge conductive member 70 proximate a second end 44 of a post 40, and a nut-body continuity element 75 located proximate a second end 54 of the connector body 50, without the presence of connector body conductive member 80.

With reference to the drawings, either one or all three of the nut-body continuity element 75, the mating edge conductive member, or O-ring 70, and connector body conductive member, or O-ring 80, may be utilized in conjunction with an integral post connector body 90. For example, the mating edge conductive member 70 may be inserted within a threaded nut 30 such that it contacts the mating edge 99 of integral post connector body 90 as implemented in an embodiment of connector 100. By further example, the connector body conductive member 80 may be position to cooperate and make contact with the recess 96 of connector body 90 and the outer internal wall 39 (see FIG. 6) of an operably attached threaded nut 30 of an embodiment of a connector 100. Those in the art should recognize that embodiments of the connector 100 may employ all three of the nut-body continuity element 75, the mating edge conductive member 70, and the connector body conductive member 80 in a single connector 100 (shown in FIG. 11). Accordingly the various advantages attributable to each of the nut-body continuity element 75, mating edge conductive member 70, and the connector body conductive member 80 may be obtained.

A method for grounding a coaxial cable 10 through a connector 100 is now described with reference to FIG. 3 which depicts a sectional side view of an embodiment of a connector 100. A coaxial cable 10 may be prepared for connector 100 attachment. Preparation of the coaxial cable 10 may involve removing the protective outer jacket 12 and drawing back the conductive grounding shield 14 to expose a portion of a conductive foil layer 15 surrounding the interior dielectric 16. Further preparation of the embodied coaxial cable 10 may include stripping the and dielectric 16 (and potential conductive foil layer 15) to expose a portion of the center conductor 18. Various other preparatory configurations of coaxial cable 10 may be employed for use with connector 100 in accordance with standard broadband communications technology and equipment. For example, the coaxial cable may be prepared without drawing back the conductive grounding shield 14, but merely stripping a portion thereof to expose the interior dielectric 16 (potentially surrounding conductive foil layer 15), and center conductor 18.

Referring again to FIG. 3, further depiction of a method for grounding a coaxial cable 10 through a connector 100 is described. A connector 100 including a post 40 having a first end 42 and second end 44 may be provided. Moreover, the provided connector may include a connector body 50 and a nut-body continuity element 75 located between the nut 30 and the connector body 50. The proximate location of the nut-body continuity element 75 should be such that the nut-body continuity element 75 makes simultaneous physical and electrical contact with the nut 30 and the connector body 50.

Grounding may be further attained and maintained by fixedly attaching the coaxial cable 10 to the connector 100. Attachment may be accomplished by insetting the coaxial cable 10 into the connector 100 such that the first end 42 of post 40 is inserted under the conductive grounding sheath or shield 14 and around the conductive foil layer 15 potentially encompassing the dielectric 16. Where the post 40 is comprised of conductive material, a grounding connection may be achieved between the received conductive grounding shield 14 of coaxial cable 10 and the inserted post 40. The ground may extend through the post 40 from the first end 42 where initial physical and electrical contact is made with the conductive grounding shield 14 to the second end 44 of the post 40. Once received, the coaxial cable 10 may be securely fixed into position by radially compressing the outer surface 57 of connector body 50 against the coaxial cable 10 thereby affixing the cable into position and sealing the connection. Furthermore, radial compression of a resilient member placed within the connector 100 may attach and/or the coaxial cable 10 to connector 100. In addition, the radial compression of the connector body 50 may be effectuated by physical deformation caused by a fastener member 60 that may compress and lock the connector body 50 into place. Moreover, where the connector body 50 is formed of materials having and elastic limit, compression may be accomplished by crimping tools, or other like means that may be implemented to permanently deform the connector body 50 into a securely affixed position around the coaxial cable 10.

As an additional step, grounding of the coaxial cable 10 through the connector 100 may be accomplished by advancing the connector 100 onto an interface port 20 until a surface of the interface port mates with a surface of the nut 30. Because the nut-body continuity element 75 is located such that it makes physical and electrical contact with the connector body 50, grounding may be extended from the post 40 or conductive foil layer 15 through the conductive grounding shield 14, then through the nut-body continuity element 75 to the nut 30, and then through the mated interface port 20. Accordingly, the interface port 20 should make physical and electrical contact with the nut 30. Advancement of the connector 100 onto the interface port 20 may involve the threading on of attached threaded nut 30 of connector 100 until a surface of the interface port 20 abuts the mating edge 49 of the post (see FIG. 7) and axial progression of the advancing connector 100 is hindered by the abutment. However, it should be recognized that embodiments of the connector 100 may be advanced onto an interface port 20 without threading and involvement of a threaded nut 30. Once advanced until progression is stopped by the conductive contact of the mating edge 49 of the post 40 with interface port 20, the connector 100 may be further shielded from ingress of unwanted electromagnetic interference. Moreover, grounding may be accomplished by physical advancement of various embodiments of the connector 100 wherein a nut-body continuity element 75 facilitates electrical connection of the connector 100 and attached coaxial cable 10 to an interface port 20.

With continued reference to FIG. 11 and additional reference to FIG. 12, further depiction of a method for grounding a coaxial cable 10 through a connector 100 is described. A connector 100 including a post 40 having a first end 42 and second end 44 may be provided. Moreover, the provided connector may include a connector body 50 and a mating edge conductive member 70 located proximate the second end 44 of post 40. The proximate location of the mating edge conductive member 70 should be such that the mating edge conductive member 70 makes physical and electrical contact with post 40. In one embodiment, the mating edge conductive member or O-ring 70 may be inserted into a threaded nut 30 until it abuts the mating edge 49 of post 40. However, other embodiments of connector 100 may locate the mating edge conductive member 70 at or very near the second end 44 of post 40 without insertion of the mating edge conductive member 70 into a threaded nut 30.

Grounding may be further attained by fixedly attaching the coaxial cable 10 to the connector 100. Attachment may be accomplished by insetting the coaxial cable 10 into the connector 100 such that the first end 42 of post 40 is inserted under the conductive grounding sheath or shield 14 and around the conductive foil layer 15 and dielectric 16. Where the post 40 is comprised of conductive material, a grounding connection may be achieved between the received conductive grounding shields 14 of coaxial cable 10 and the inserted post 40. The ground may extend through the post 40 from the first end 42 where initial physical and electrical contact is made with the conductive grounding shield 14 to the mating edge 49 located at the second end 44 of the post 40. Once, received, the coaxial cable 10 may be securely fixed into position by radially compressing the outer surface 57 of connector body 50 against the coaxial cable 10 thereby affixing the cable into position and sealing the connection. The radial compression of the connector body 50 may be effectuated by physical deformation caused by a fastener member 60 that may compress and lock the connector body 50 into place. Moreover, where the connector body 50 is formed of materials having and elastic limit, compression may be accomplished by crimping tools, or other like means that may be implemented to permanently deform the connector body 50 into a securely affixed position around the coaxial cable 10.

As an additional step, grounding of the coaxial cable 10 through the connector 100 may be accomplished by advancing the connector 100 onto an interface port 20 until a surface of the interface port mates with the mating edge conductive member 70. Because the mating edge conductive member 70 is located such that it makes physical and electrical contact with post 40, grounding may be extended from the post 40 through the mating edge conductive member 70 and then through the mated interface port 20. Accordingly, the interface port 20 should make physical and electrical contact with the mating edge conductive member 70. The mating edge conductive member 70 may function as a conductive seal when physically pressed against the interface port 20. Advancement of the connector 100 onto the interface port 20 may involve the threading on of attached threaded nut 30 of connector 100 until a surface of the interface port 20 abuts the mating edge conductive member 70 and axial progression of the advancing connector 100 is hindered by the abutment. However, it should be recognized that embodiments of the connector 100 may be advanced onto an interface port 20 without threading and involvement of a threaded nut 30. Once advanced until progression is stopped by the conductive sealing contact of mating edge conductive member 70 with interface port 20, the connector 100 may be shielded from ingress of unwanted electromagnetic interference. Moreover, grounding may be accomplished by physical advancement of various embodiments of the connector 100 wherein a mating edge conductive member 70 facilitates electrical connection of the connector 100 and attached coaxial cable 10 to an interface port 20.

A method for electrically coupling the nut 30 and the connector body 50 is now described with reference to FIGS. 1-16. The method of electrically coupling the nut 30 and the connector body 50 may include the steps of providing a connector body 50 attached to the post 40 wherein the connector body 50 includes a first end 52 and a second end 54, the first end 52 configured to deformably compress against and seal a received coaxial cable 10; a rotatable coupling element 30 attached to the post 40; and a nut-body continuity element 75 located between the connector body 50 and the rotatable coupling element 30, proximate the second end 54 of the connector body 50, wherein the nut-body continuity element 75 facilitates the grounding of the coaxial cable 10 by electrically coupling the rotatable coupling element 30 to the connector body 50, and advancing the connector 100 onto an interface port 20.

Another method for providing a coaxial cable connector is now described with references to FIGS. 1-16. The method may comprise the steps of providing a coaxial cable connector including: a connector body 50, 250 attached to a post 40, wherein the connector body 50, 250 has a first end 52 and a second end 54, and a port coupling element 30, 230 rotatable about the post 40, the port coupling element 30, 230 separated from the connector body 50, 250 by a distance; and disposing a continuity element 75, 275 positioned between the port coupling element 30, 230 and the connector body 50, 250 proximate the second end 54 of the connector body 50, 250; wherein the continuity element 75, 275 establishes and maintains electrical continuity between the connector body 50, 250 and the port coupling element 30, 230.

Referring now specifically to FIGS. 13-16, connector 200 may include a nut-body continuity element 275 placed between the nut 230 and the connector body 250 to allow continuity and/or continuous physical and electrical contact or communication between the nut 230 and the connector body 250 in the radial direction. Embodiments of connector 200 may include a connector body 250 attached to a post 240, the connector body 250 having a first end and a second end, wherein the connector body 250 includes an annular outer recess proximate the second end, a port coupling element 230 rotatable about the post 240, wherein the port coupling element 230 has an inner surface, and a continuity element 275 having a first surface 271 and a second surface 272, the first surface 271 contacting the inner surface of the port coupling element 230 and the second surface 272 contacting the outer annular recess of the connector body 250, wherein the continuity element 275 establishes and maintains electrical communication between the port coupling element 230 and the connector body 250 in a radial direction. Moreover, continuous conductive and electrical continuity between the nut 230 and the connector body 250 in the radial direction can be established by the physical and electrical contact between the connector body 250 and the nut-body continuity element 275, wherein the nut-body continuity element 275 is simultaneously in physical and electrical contact with the nut 230. Moreover, nut-body continuity element 275 may have a slight bend to provide radial separation between contact points. For instance, the point on first surface 271 of the nut-body continuity element 275 contacting the nut 230 may be of a longer radial distance, $r_1$, from the center conductor than the radial distance, $r_2$, of the point on the second surface 272 of the nut-body continuity element 275 contacting the connector body 250. In other words, the nut-body continuity element 275 may be an elliptical shape, wherein there is a major radius and a minor radius. The major radius, being larger than the minor radius, is the distance between a center of the nut-body continuity element 275 and the point where the nut-body continuity element 275 contacts the inner surface diameter of the nut 230 (i.e. internal wall 239 of nut 230). The minor radius, being smaller than the major radius, is the distance between the center of the nut-body continuity element 275 and the point where the nut-body continuity element 275 contacts the outer surface diameter of the connector body 250. Therefore, nut-body continuity element 275 may physically and electrically contact both the nut 230 and the connector body 250, despite the radial separation between the two components.

While this invention has been described in conjunction with the specific embodiments outlined above, it is evident that many alternatives, modifications and variations will be apparent to those skilled in the art. Accordingly, the embodiments of the invention as set forth above are intended to be illustrative, not limiting. Various changes may be made without departing from the spirit and scope of the invention as defined in the following claims.

The following is claimed:

1. A coaxial cable connector comprising:

a body having a continuity engaging body portion, a sealing member engaging body portion, a coupler engaging body portion, and a post engaging body portion, the coupler engaging body portion including a forwardly facing body surface;

a post having a coupler engaging post portion and a body engaging post portion, the coupler engaging post portion including an outwardly extending post protrusion having a coupler engaging post protrusion surface;

a coupler having an inner coupler surface, a continuity engaging coupler portion, a sealing member engaging coupler portion, a body engaging coupler portion, and a post engaging coupler portion, the post engaging coupler portion including a first inwardly extending coupler lip surface configured to face a forward direction and engage the coupler engaging post protrusion surface when the connector is in an assembled state, the continuity engaging coupler portion being configured to be located rearward from the sealing member engaging coupler portion and located rearward from the post engaging coupler portion when the connector is in the assembled state, the body engaging coupler portion including a second inwardly extending coupler lip surface configured to face a rearward direction and engage the forwardly facing body surface of the coupler engaging body portion when the connector is in the assembled state, and the continuity engaging coupler portion including a rearwardly facing coupler surface when the connector is in the assembled state;

a continuity member configured to provide grounding continuity even when the connector is in a loose state, the continuity member being positioned outside the inner coupler surface and outside the body such that no portion of the continuity member is located either inside the body or inside the rearwardly facing coupler surface of the continuity engaging coupler portion when the connector is in the assembled state;

wherein the continuity member does not contact the second inwardly extending coupler lip surface of the body engaging coupler portion when the connector is in the assembled state;

wherein the body extends between the continuity member and a portion of the post when the connector is in the assembled state, and the continuity member extends around a section of the body when the connector is in the assembled state; and wherein the coupler is configured to move between a first position, where the continuity member contacts the rearwardly facing coupler surface of the continuity engaging coupler portion and where the second inwardly extending coupler lip surface of the body engaging coupler portion does not engage the forwardly facing body surface of the coupler engaging body portion, and a second position, where the continuity member contacts the rearwardly facing coupler surface of the continuity engaging coupler portion and where the second inwardly extending coupler lip surface of the body engaging coupler portion engages the forwardly facing body surface of the coupler engaging body portion so as to prevent the coupler from over-compressing the continuity member when the coupler moves between the first and second positions.

2. The coaxial cable connector of claim 1, wherein the continuity member is C-shaped.

3. The coaxial cable connector of claim 1, wherein the continuity member comprises hard metal.

4. The coaxial cable connector of claim 1, wherein the continuity member is metallic.

5. The coaxial cable connector of claim 1, wherein the continuity member includes a forward continuity portion and a rearward continuity portion, the forward continuity portion being configured to contact the rearwardly facing coupler surface of the continuity engaging coupler portion when the connector is in the assembled state, and the rearward continuity portion being configured to contact the continuity engaging body portion when the connector is in the assembled state.

6. The coaxial cable connector of claim 1, wherein the second inwardly extending coupler lip surface of the body engaging coupler portion is axially spaced away from the rearwardly facing coupler surface of the continuity engaging coupler portion.

7. The coaxial cable connector of claim 1, wherein the second inwardly extending coupler lip surface of the body engaging coupler portion is located axially forward from the rearwardly facing coupler surface of the continuity engaging coupler portion when the connector is in the assembled state.

8. The coaxial cable connector of claim 1, wherein the inner coupler surface extends from the second inwardly extending coupler lip surface of the body engaging coupler portion.

9. The coaxial cable connector of claim 8, further comprising a sealing member configured to sealingly engage the inner coupler surface when the connector is in the assembled state.

10. The coaxial cable connector of claim 9, wherein the sealing member comprises an O-ring.

11. The coaxial cable connector of claim 1, wherein the body extends inside the inner coupler surface when the connector is in the assembled state.

12. The coaxial cable connector of claim 1, wherein the body is configured to receive a sealing member and allow the sealing member to form a seal between the inner coupler surface and the body when the connector is in the assembled state.

13. The coaxial cable connector of claim 1, wherein the body, the post, the coupler, and continuity member each comprise separate and distinct structures, each having at least one component and each configured to move relative to one another during assembly of the coaxial cable connector.

14. The coaxial cable connector of claim 1, wherein the body and the post are separate components of the coaxial cable connector.

15. The coaxial cable connector of claim 1, wherein the body and the post are physically and functionally separate components.

16. The coaxial cable connector of claim 1, wherein the body and the post do not comprise a single integral component.

17. The coaxial cable connector of claim 1, wherein the body and the post are configured to be interlocked with one another to prevent axial movement of one relative to the other when the connector is in the assembled state.

18. The coaxial cable connector of claim 1, wherein the body and the post are configured to be interlocked together.

19. The coaxial cable connector of claim 1, wherein the continuity engaging coupler portion comprises a radial surface.

20. The coaxial cable connector of claim 19, wherein the radial surface is configured to face an end of the coaxial cable connector when the coaxial cable connector is in the assemble state.

21. The coaxial cable connector of claim 19, wherein the radial surface is configured to face the rearward direction when the coaxial cable connector is in the assembled state.

22. The coaxial cable connector of claim 19, wherein the radial surface is not configured to face an end of the coupler.

23. The coaxial cable connector of claim 19, wherein the radial surface comprises a radial end-most surface of the coupler.

24. The coaxial cable connector of claim 19, wherein the radial surface is radially spaced outward from the inner coupler surface.

25. The coaxial cable connector of claim 1, wherein the continuity engaging coupler portion is radially spaced outward from the inner coupler surface.

26. The coaxial cable connector of claim 1, wherein the continuity engaging coupler portion is axially spaced rearward from the inner coupler surface.

27. The coaxial cable connector of claim 1, wherein the inner coupler surface is located inside the coupler.

28. The coaxial cable connector of claim 1, wherein the inner coupler surface is located on an edge of the coupler.

29. The coaxial cable connector of claim 1, wherein the inner coupler surface is located at an edge of the coupler.

30. The coaxial cable connector of claim 1, wherein the inner coupler surface faces an inward direction.

31. The coaxial cable connector of claim 1, wherein the inner coupler surface is located axially forward from the continuity engaging coupler portion.

32. The coaxial cable connector of claim 1, wherein the inner coupler surface is located radially inward from the continuity engaging coupler portion.

33. The coaxial cable connector of claim 1, wherein the inner coupler surface faces an inward direction and extends from the continuity engaging coupler portion, and the continuity member faces the rearward direction.

34. The coaxial cable connector of claim 1, wherein the inner coupler surface faces a first direction and extends from the continuity engaging coupler portion, and the continuity engaging coupler portion faces a second direction orthogonal to the first direction.

35. The coaxial cable connector of claim 1, wherein the continuity engaging body portion comprises an outer surface.

36. The coaxial cable connector of claim 1, wherein the continuity engaging body portion comprises an outer annular surface.

37. The coaxial cable connector of claim 1, wherein the continuity engaging body portion is cylindrical.

38. The coaxial cable connector of claim 1, wherein the continuity engaging body portion does not include a forward end of the body.

39. The coaxial cable connector of claim 1, wherein the continuity engaging body portion does not include an end of the body closest to the coupler when the coaxial cable connector is in the assembled state.

40. The coaxial cable connector of claim 1, wherein the continuity engaging body portion is located proximate to a forward end of the body.

41. The coaxial cable connector of claim 1, wherein the continuity engaging body portion is located proximate to an end of the body closest to the coupler when the coaxial cable connector is in the assembled state.

42. The coaxial cable connector of claim 1, wherein the body includes a forward body end, and the continuity engaging body portion and the forward body end comprise separate and distinct portions of the body.

43. The coaxial cable connector of claim 1, wherein the continuity member is configured to maintain a consistent ground path between the coupler and the body even when the coupler is in the loose state.

44. The coaxial cable connector of claim 1, wherein the continuity member is configured to maintain a constant ground path between the coupler and the body even when the coupler is in the loose state.

45. The coaxial cable connector of claim 1, wherein the continuity member is configured to maintain a consistent ground path in an axial direction between the coupler and the body even when the coupler is in the loose state.

46. The coaxial cable connector of claim 1, wherein the continuity member is configured to maintain an electrical connection between the coupler and the body in an axial direction, wherein the axial direction comprises a general direction of a main axis of the coaxial cable connector.

47. The coaxial cable connector of claim 1, wherein the continuity member is configured to maintain an electrical connection between the coupler and the body in an axial direction, wherein the axial direction is not perfectly parallel to a main axis of the coaxial cable connector.

48. The coaxial cable connector of claim 1, wherein grounding continuity comprises a consistent ground path.

49. The coaxial cable connector of claim 1, wherein grounding continuity comprises a constant ground path.

50. A coaxial cable connector comprising:

a body having a continuity engaging body portion, a sealing member engaging body portion, a coupler engaging body portion, and a post engaging body portion, the coupler engaging body portion including a forwardly facing body surface;

a post having a coupler engaging post portion and a body engaging post portion, the coupler engaging post portion including an outwardly extending post protrusion having a coupler engaging post protrusion surface;

a coupler having an inner coupler surface, a continuity engaging coupler portion, a sealing member engaging coupler portion, a body engaging coupler portion, and a post engaging coupler portion, the post engaging coupler portion including a first inwardly extending coupler lip surface configured to face a forward direction and engage the coupler engaging post protrusion surface when the connector is in an assembled state, the continuity engaging coupler portion being configured to be located rearward from the sealing member engaging coupler portion and located rearward from the post engaging coupler portion when the connector is in the assembled state, the body engaging coupler portion including a second inwardly extending coupler lip surface configured to face a rearward direction and engage the forwardly facing body surface of the coupler engaging body portion when the connector is in the assembled state, the continuity engaging coupler portion including a rearwardly facing coupler surface when the connector is in the assembled state, and the inner coupler surface is configured to extend toward the second inwardly extending coupler lip surface of the body engaging coupler portion;

a continuity member configured to provide grounding continuity, the continuity member being positioned outside the inner coupler surface and outside the body such that no portion of the continuity member is located either inside the body or inside the rearwardly facing coupler surface of the continuity engaging coupler portion when the connector is in the assembled state;

a sealing member configured to sealingly engage the inner coupler surface when the connector is in the assembled state;

wherein the continuity member is metallic and does not contact the second inwardly extending coupler lip surface of the body engaging coupler portion when the connector is in the assembled state;

wherein the body extends between the continuity member and a portion of the post when the connector is in the assembled state, and the continuity member extends around a section of the body when the connector is in the assembled state;

wherein the coupler is configured to move between a first position, where the continuity member contacts the rearwardly facing coupler surface of the continuity engaging coupler portion and where the second inwardly extending coupler lip surface of the body engaging coupler portion does not engage the forwardly facing body surface of the coupler engaging body portion, and a second position, where the continuity member contacts the rearwardly facing coupler surface of the continuity engaging coupler portion and where the second inwardly extending coupler lip surface of the body engaging coupler portion engages the forwardly facing body surface of the coupler engaging body portion.

51. The coaxial cable connector of claim 50, wherein the continuity member is C-shaped.

52. The coaxial cable connector of claim 50, wherein the continuity member comprises hard metal.

53. The coaxial cable connector of claim 50, wherein the continuity member includes a forward continuity portion and a rearward continuity portion, the forward continuity portion is configured to contact the rearwardly facing coupler surface of the continuity engaging coupler portion when the connector is in the assembled state, and the rearward continuity portion is configured to contact the continuity engaging body portion when the connector is in the assembled state.

54. The coaxial cable connector of claim 50, wherein the second inwardly extending coupler lip surface of the body engaging coupler portion is axially spaced away from the rearwardly facing coupler surface of the continuity engaging coupler portion.

55. The coaxial cable connector of claim 50, wherein the second inwardly extending coupler lip surface of the body engaging coupler portion is located axially forward from the rearwardly facing coupler surface of the continuity engaging coupler portion when the connector is in the assembled state.

56. The coaxial cable connector of claim 50, wherein the inner coupler surface extends from the second inwardly extending coupler lip surface of the body engaging coupler portion.

57. The coaxial cable connector of claim 50, wherein the sealing member comprises an O-ring.

58. The coaxial cable connector of claim 50, wherein the body extends inside the inner coupler surface when the connector is in the assembled state.

59. The coaxial cable connector of claim 50, wherein the body, the post, the coupler, and continuity member each comprise separate and distinct structures, each having at least one component and each configured to move relative to one another during assembly of the coaxial cable connector.

60. The coaxial cable connector of claim 50, wherein the body and the post are separate components of the coaxial cable connector.

61. The coaxial cable connector of claim 50, wherein the body and the post are physically and functionally separate components.

62. The coaxial cable connector of claim 50, wherein the body and the post do not comprise a single integral component.

63. The coaxial cable connector of claim 50, wherein the body and the post are configured to be interlocked with one another to prevent axial movement of one relative to the other when the connector is in the assembled state.

64. The coaxial cable connector of claim 50, wherein the body and the post are configured to be interlocked together when assembled.

65. The coaxial cable connector of claim 50, wherein the continuity engaging coupler portion comprises a radial surface.

66. The coaxial cable connector of claim 65, wherein the radial surface is configured to face an end of the coaxial cable connector when the coaxial cable connector is in the assemble state.

67. The coaxial cable connector of claim 65, wherein the radial surface is configured to face the rearward direction when the coaxial cable connector is in the assembled state.

68. The coaxial cable connector of claim 65, wherein the radial surface is not configured to face an end of the coupler.

69. The coaxial cable connector of claim 65, wherein the radial surface comprises a radial end-most surface of the coupler.

70. The coaxial cable connector of claim 65, wherein the radial surface is radially spaced outward from the inner coupler surface.

71. The coaxial cable connector of claim 50, wherein the continuity engaging coupler portion is radially spaced outward from the inner coupler surface.

72. The coaxial cable connector of claim 50, wherein the continuity engaging coupler portion is axially spaced rearward from the inner coupler surface.

73. The coaxial cable connector of claim 50, wherein the inner coupler surface is located inside the coupler.

74. The coaxial cable connector of claim 50, wherein the inner coupler surface is located on an edge of the coupler.

75. The coaxial cable connector of claim 50, wherein the inner coupler surface is located at an edge of the coupler.

76. The coaxial cable connector of claim 50, wherein the inner coupler surface faces an inward direction.

77. The coaxial cable connector of claim 50, wherein the inner coupler surface is located axially forward from the continuity engaging coupler portion.

78. The coaxial cable connector of claim 50, wherein the inner coupler surface is located radially inward from the continuity engaging coupler portion.

79. The coaxial cable connector of claim 50, wherein the inner coupler surface faces an inward direction and extends from the continuity engaging coupler portion, and the continuity member faces the rearward direction.

80. The coaxial cable connector of claim 50, wherein the inner coupler surface faces a first direction and extends from the continuity engaging coupler portion, and the continuity engaging coupler portion faces a second direction orthogonal to the first direction.

81. The coaxial cable connector of claim 50, wherein the continuity engaging body portion comprises an outer surface.

82. The coaxial cable connector of claim 50, wherein the continuity engaging body portion comprises an outer annular surface.

83. The coaxial cable connector of claim 50, wherein the continuity engaging body portion is cylindrical.

84. The coaxial cable connector of claim 50, wherein the continuity engaging body portion does not include a forward end of the body.

85. The coaxial cable connector of claim 50, wherein the continuity engaging body portion does not include an end of the body closest to the coupler when the coaxial cable connector is in the assembled state.

86. The coaxial cable connector of claim 50, wherein the continuity engaging body portion is located proximate to a forward end of the body.

87. The coaxial cable connector of claim 50, wherein the continuity engaging body portion is located proximate to an end of the body closest to the coupler when the coaxial cable connector is in the assembled state.

88. The coaxial cable connector of claim 50, wherein the body includes a forward body end, and the continuity engaging body portion and the forward body end comprise separate and distinct portions of the body.

89. The coaxial cable connector of claim 50, wherein the continuity member is configured to maintain a consistent ground path between the coupler and the body even when the coupler is in the loose state.

90. The coaxial cable connector of claim 50, wherein the continuity member is configured to maintain a constant ground path between the coupler and the body even when the coupler is in a loose state.

91. The coaxial cable connector of claim 50, wherein the continuity member is configured to maintain a consistent ground path in an axial direction between the coupler and the body even when the coupler is in a loose state.

92. The coaxial cable connector of claim 50, wherein the continuity member is configured to maintain an electrical connection between the coupler and the body in an axial direction, wherein the axial direction comprises a general direction of a main axis of the coaxial cable connector.

93. The coaxial cable connector of claim 50, wherein the continuity member is configured to maintain an electrical connection between the coupler and the body in an axial direction, wherein the axial direction is not perfectly parallel to a main axis of the coaxial cable connector.

94. The coaxial cable connector of claim 50, wherein grounding continuity comprises a consistent ground path.

95. The coaxial cable connector of claim 50, wherein grounding continuity comprises a constant ground path.

96. A coaxial cable connector comprising:

a body having a continuity engaging body portion, a sealing member engaging body portion, a coupler engaging body portion, and a post engaging body portion, the coupler engaging body portion including a forwardly facing body surface;

a post having a coupler engaging post portion and a body engaging post portion, the coupler engaging post portion including an outwardly extending post protrusion having a coupler engaging post protrusion surface;

a coupler having an inner coupler surface, a continuity engaging coupler portion, a sealing member engaging coupler portion, a body engaging coupler portion, and a post engaging coupler portion, the post engaging coupler portion including a first inwardly extending coupler lip surface configured to face a forward direction and engage the coupler engaging post protrusion surface when the connector is in an assembled state, the continuity engaging coupler portion being configured to be located rearward from the sealing member engaging coupler portion and located rearward from the post engaging coupler portion when the connector is in the assembled state, the body engaging coupler portion including a second inwardly extending coupler lip surface configured to face a rearward direction and engage the forwardly facing body surface of the coupler engaging body portion when the connector is in the assembled state, the continuity engaging coupler portion including a rearwardly facing coupler surface when the connector is in the assembled state, and the inner coupler surface is configured to extend toward the second inwardly extending coupler lip surface of the body engaging coupler portion;

a continuity member configured to provide grounding continuity, the continuity member being positioned outside the inner coupler surface and outside the body such that no portion of the continuity member is located either inside the body or inside the rearwardly facing coupler surface of the continuity engaging coupler portion when the connector is in the assembled state;

a sealing member configured to sealingly engage the inner coupler surface when the connector is in the assembled state;

wherein the continuity member is metallic and does not contact the second inwardly extending coupler lip surface of the body engaging coupler portion when the connector is in the assembled state;

wherein the body extends between the continuity member and a portion of the post when the connector is in the assembled state, and the continuity member extends around a section of the body when the connector is in the assembled state;

wherein the coupler is configured to move between a first position, where the continuity member contacts the rearwardly facing coupler surface of the continuity engaging coupler portion and where the second inwardly extending coupler lip surface of the body engaging coupler portion does not engage the forwardly facing body surface of the coupler engaging body portion, and a second position, where the continuity member contacts the rearwardly facing coupler surface of the continuity engaging coupler portion and where the second inwardly extending coupler lip surface of the body engaging coupler portion engages the forwardly facing body surface of the coupler engaging body portion;

wherein the continuity member is C-shaped;

wherein the second inwardly extending coupler lip surface of the body engaging coupler portion is located axially forward from the rearwardly facing coupler surface of the continuity engaging coupler portion when the connector is in the assembled state;

wherein the sealing member comprises an O-ring;

wherein the body extends inside the inner coupler surface when the connector is in the assembled state; and wherein the body, the post, the coupler, and continuity member each comprise separate and distinct structures, each having at least one component, wherein the body and the coupler are configured to move relative to one another when the connector is in the assembled state.

97. The coaxial cable connector of claim 96, wherein the body and the post are separate components of the coaxial cable connector.

98. The coaxial cable connector of claim 96, wherein the body and the post are physically and functionally separate components.

99. The coaxial cable connector of claim 96, wherein the body and the post do not comprise a single integral component.

100. The coaxial cable connector of claim 96, wherein the body and the post are configured to be interlocked with one another to prevent axial movement of one relative to the other when the connector is in the assembled state.

101. The coaxial cable connector of claim 96, wherein the body and the post are configured to be interlocked together when assembled.

102. The coaxial cable connector of claim 96, wherein the continuity engaging coupler portion comprises a radial surface.

103. The coaxial cable connector of claim 102, wherein the radial surface is configured to face an end of the coaxial cable connector when the coaxial cable connector is in an assemble state.

104. The coaxial cable connector of claim 102, wherein the radial surface is configured to face the rearward direction when the coaxial cable connector is in the assembled state.

105. The coaxial cable connector of claim 102, wherein the radial surface is not configured to face an end of the coupler.

106. The coaxial cable connector of claim 102, wherein the radial surface comprises a radial end-most surface of the coupler.

107. The coaxial cable connector of claim 102, wherein the radial surface is radially spaced outward from the inner coupler surface.

108. The coaxial cable connector of claim 96, wherein the continuity engaging coupler portion is radially spaced outward from the inner coupler surface.

109. The coaxial cable connector of claim 96, wherein the continuity engaging coupler portion is axially spaced rearward from the inner coupler surface.

110. The coaxial cable connector of claim 96, wherein the inner coupler surface is located inside the coupler.

111. The coaxial cable connector of claim 96, wherein the inner coupler surface is located on an edge of the coupler.

112. The coaxial cable connector of claim 96, wherein the inner coupler surface is located at an edge of the coupler.

113. The coaxial cable connector of claim 96, wherein the inner coupler surface faces an inward direction.

114. The coaxial cable connector of claim 96, wherein the inner coupler surface is located axially forward from the continuity engaging coupler portion.

115. The coaxial cable connector of claim 96, wherein the inner coupler surface is located radially inward from the continuity engaging coupler portion.

116. The coaxial cable connector of claim 96, wherein the inner coupler surface faces an inward direction and extends from the continuity engaging coupler portion, and the continuity member faces the rearward direction.

117. The coaxial cable connector of claim 96, wherein the inner coupler surface faces a first direction and extends from the continuity engaging portion, and the continuity engaging coupler portion faces a second direction orthogonal to the first direction.

118. The coaxial cable connector of claim 96, wherein the continuity engaging body portion comprises an outer surface.

119. The coaxial cable connector of claim 96, wherein the continuity engaging body portion comprises an outer annular surface.

120. The coaxial cable connector of claim 96, wherein the continuity engaging body portion is cylindrical.

121. The coaxial cable connector of claim 96, wherein the continuity engaging body portion does not include a forward end of the body.

122. The coaxial cable connector of claim 96, wherein the continuity engaging body portion does not include an end of the body closest to the coupler when the coaxial cable connector is in the assembled state.

123. The coaxial cable connector of claim 96, wherein the continuity engaging body portion is located proximate to a forward end of the body.

124. The coaxial cable connector of claim 96, wherein the continuity engaging body portion is located proximate to an end of the body closest to the coupler when the coaxial cable connector is in the assembled state.

125. The coaxial cable connector of claim 96, wherein the body includes a forward body end, and the continuity engaging body portion and the forward body end comprise separate and distinct portions of the body.

126. The coaxial cable connector of claim 96, wherein the continuity member is configured to maintain a consistent ground path between the coupler and the body even when the coupler is in a loose state.

127. The coaxial cable connector of claim 96, wherein the continuity member is configured to maintain a constant ground path between the coupler and the body even when the coupler is in a loose state.

128. The coaxial cable connector of claim 96, wherein the continuity member is configured to maintain a consistent ground path in an axial direction between the coupler and the body even when the coupler is in a loose state.

129. The coaxial cable connector of claim 96, wherein the continuity member is configured to maintain an electrical connection between the coupler and the body in an axial direction, wherein the axial direction comprises a general direction of a main axis of the coaxial cable connector.

130. The coaxial cable connector of claim 96, wherein the continuity member is configured to maintain an electrical connection between the coupler and the body in an axial direction, wherein the axial direction is not perfectly parallel to a main axis of the coaxial cable connector.

131. The coaxial cable connector of claim 96, wherein grounding continuity comprises a consistent ground path.

132. The coaxial cable connector of claim 96, wherein grounding continuity comprises a constant ground path.

* * * * *